US011142905B2

(12) United States Patent
Kelly et al.

(10) Patent No.: US 11,142,905 B2
(45) Date of Patent: Oct. 12, 2021

(54) SYSTEMS FOR RECESSING SUBFLOOR STRUCTURES

(71) Applicant: Schluter Systems L.P., Plattsburgh, NY (US)

(72) Inventors: Lyle James Kelly, Rigaud (CA); Joshua Michael Price, Morrisonville, NY (US); John Christopher Daffer, Knoxville, TN (US)

(73) Assignee: Schuter Systems L.P., Plattsburgh, NY (US)

( * ) Notice: Subject to any disclaimer, the term of this patent is extended or adjusted under 35 U.S.C. 154(b) by 36 days.

(21) Appl. No.: 16/507,421

(22) Filed: Jul. 10, 2019

(65) Prior Publication Data

US 2020/0018064 A1 Jan. 16, 2020

Related U.S. Application Data

(60) Provisional application No. 62/849,632, filed on May 17, 2019, provisional application No. 62/696,730, filed on Jul. 11, 2018.

(51) Int. Cl.
*E04B 5/02* (2006.01)
*A47K 3/40* (2006.01)

(52) U.S. Cl.
CPC ..... *E04B 5/02* (2013.01); *A47K 3/405* (2013.01)

(58) Field of Classification Search
CPC ..... E04G 17/06; E04G 25/06; E04G 25/061; E04G 17/14; E04C 2003/026; B60P 7/15
USPC ..... 52/459, 460, 461
See application file for complete search history.

(56) References Cited

U.S. PATENT DOCUMENTS 1,253,486 A 1/1918 Hammer
1,280,112 A * 9/1918 Veit ..... E04G 25/06 248/354.4
1,381,663 A 6/1921 Roeder
1,781,063 A * 11/1930 Jessen ..... E04G 25/061 254/104
1,787,858 A * 1/1931 Gray ..... E04G 25/06 254/98
1,797,616 A * 3/1931 Martin ..... E04G 25/06 254/114
1,920,433 A * 8/1933 Poole ..... E04G 25/06 254/100
2,594,605 A 12/1946 Zoppelt
2,508,779 A * 5/1950 Vocisano ..... E04G 25/061 248/357
2,541,793 A * 2/1951 Thompson ..... E21D 15/24 248/354.3
2,963,127 A * 12/1960 Manville ..... E04B 2/56 52/693

(Continued)

*Primary Examiner* — Gisele D Ford
(74) *Attorney, Agent, or Firm* — Jason Jones

(57) ABSTRACT

A method is provided for supporting a recessed subfloor panel in a lowered position relative to an adjacent, primary subfloor, the primary subfloor being supported from beneath by one or more floor supports. The method includes positioning a spanning brace between a pair of floor supports and adjusting a length of the spanning brace such that the spanning brace engages and is supported by lateral, vertical sides of the pair of floor supports. A recessed subfloor panel is supported atop the spanning brace, the recessed subfloor panel being supported at a lower elevation than an adjacent, primary subfloor.

9 Claims, 28 Drawing Sheets

(56) References Cited

U.S. PATENT DOCUMENTS 3,027,140 A * 3/1962 Holzbach ..... E04G 25/065 254/98
3,049,328 A * 8/1962 Bishop ..... B60P 7/15 52/632
3,052,485 A * 9/1962 Keener ..... B60P 7/15 410/145
3,110,506 A * 11/1963 O'Brien ..... B60P 7/15 410/151
3,356,330 A * 12/1967 Rambelle ..... E04G 25/04 248/354.5
3,570,412 A * 3/1971 Holman, Jr. ..... B60P 7/15 410/153
3,655,161 A * 4/1972 Schueler ..... E04G 25/06 254/100
3,774,939 A * 11/1973 Freads ..... B60P 7/15 410/149
3,836,174 A * 9/1974 Holman, Jr. ..... B60P 7/15 410/149
4,449,704 A * 5/1984 Goulter ..... B25B 1/02 254/108
4,572,494 A * 2/1986 Goulter ..... B25B 1/02 269/329
4,659,051 A 4/1987 Propp et al.
4,669,934 A * 6/1987 Wisecarver ..... B60P 7/15 292/259 R
4,737,056 A * 4/1988 Hunt ..... B60P 7/15 224/404
5,031,724 A * 7/1991 Quinn ..... E04G 25/06 182/186.6
5,243,715 A 9/1993 Barmak
5,281,063 A * 1/1994 Austin, III ..... B60P 7/15 211/105.3
5,310,153 A * 5/1994 Jackson ..... E04G 25/06 248/354.5
5,329,858 A * 7/1994 Morris ..... B60P 7/15 105/178
5,472,301 A * 12/1995 Wallen ..... B60P 7/15 410/143
5,653,415 A * 8/1997 Schworer ..... E04G 25/061 248/354.1
5,697,742 A * 12/1997 House ..... B60P 7/15 410/121
5,769,580 A * 6/1998 Purvis ..... B60P 7/15 410/143
5,988,963 A * 11/1999 Shiau ..... B60P 7/15 410/143
6,014,848 A * 1/2000 Hilburn, Jr. ..... E01D 19/065 52/396.04
6,068,084 A 5/2000 Taormina
6,158,706 A * 12/2000 Johnson ..... E04G 25/06 248/188.4
6,217,015 B1 * 4/2001 Kulla ..... E04G 21/1841 269/296
6,247,882 B1 * 6/2001 Huang ..... B60P 7/15 410/143
6,256,939 B1 * 7/2001 Snyder ..... E04D 11/007 52/126.6
6,360,510 B1 3/2002 Woodrum et al.
6,394,405 B1 * 5/2002 Roxton ..... E04G 25/04 248/354.1
6,408,583 B1 6/2002 Hertweck
6,419,434 B1 * 7/2002 Rahn ..... B60P 7/15 410/143
6,467,741 B1 10/2002 Shih
6,505,803 B1 * 1/2003 Hernandez ..... A47B 51/00 248/354.5
6,581,347 B1 * 6/2003 Knak ..... E04B 1/6815 404/58
6,612,533 B2 9/2003 Biles et al.
6,736,371 B1 * 5/2004 Burrows ..... B60P 7/15 254/114
6,746,183 B1 * 6/2004 Sullivan ..... E04G 25/06 405/272
6,931,807 B2 * 8/2005 Braun ..... E01D 19/062 404/47
7,007,315 B2 3/2006 Stonecipher
7,275,731 B1 10/2007 Shinault
8,172,494 B1 * 5/2012 Knox ..... B60P 1/00 410/89
8,202,029 B2 * 6/2012 Chou ..... B60P 7/15 410/143
8,561,224 B2 10/2013 Cook
8,967,745 B2 3/2015 Booth
9,120,415 B1 * 9/2015 Harris ..... B60P 7/15
9,481,286 B1 * 11/2016 Xiao ..... F16C 3/03
D773,285 S * 12/2016 Lau ..... D8/355
9,549,623 B1 * 1/2017 Snell ..... A47B 88/975
9,644,363 B2 5/2017 Meyers
9,770,140 B2 9/2017 Cook
9,771,713 B2 9/2017 DeJesus et al.
9,889,546 B1 * 2/2018 White ..... B25B 27/10
10,132,427 B1 * 11/2018 Park ..... E04G 25/065
10,570,632 B1 * 2/2020 Hartman ..... E04G 17/14
D884,461 S * 5/2020 Allen ..... D8/354
2002/0139910 A1 * 10/2002 Shih ..... E04G 25/065 248/200.1
2003/0006354 A1 * 1/2003 Biles ..... F16M 13/02 248/354.1
2003/0222191 A1 * 12/2003 Tsai ..... F16M 13/02 248/354.1
2003/0223839 A1 * 12/2003 Trine ..... B60P 7/15 410/151
2005/0056760 A1 * 3/2005 Carlson ..... E04G 25/06 248/354.3
2005/0161571 A1 * 7/2005 Wood ..... E04G 25/06 248/354.3
2007/0264089 A1 * 11/2007 McCracken ..... E04G 25/061 405/272
2008/0244996 A1 * 10/2008 Gillespie ..... E04G 25/061 52/169.9
2010/0037537 A1 * 2/2010 Lee ..... E04G 25/061 52/126.6
2011/0131893 A1 * 6/2011 Chen ..... E04G 25/06 52/126.6
2012/0034023 A1 * 2/2012 Wang ..... B60P 7/15 403/109.3
2012/0079652 A1 4/2012 Lemire et al.
2014/0133899 A1 * 5/2014 Huang ..... E04G 25/06 403/109.2
2014/0353442 A1 * 12/2014 Ye ..... E04B 9/006 248/200.1
2015/0167330 A1 * 6/2015 Berger ..... E04G 17/007 52/741.1
2017/0226728 A1 8/2017 Meyers
2018/0245360 A1 * 8/2018 Woodford ..... E04G 23/0229
2019/0194961 A1 * 6/2019 Bond ..... E04G 11/38
2019/0366907 A1 * 12/2019 Kanczuzewski ..... B60P 7/0815

* cited by examiner

SYSTEMS FOR RECESSING SUBFLOOR STRUCTURES

RELATED CASES

Priority is claimed of and to U.S. Provisional Patent Application Ser. No. 62/696,730, filed Jul. 11, 2018, and U.S. Provisional Patent Application Ser. No. 62/849,632, filed May 17, 2019, each of which is hereby incorporated herein by reference in its entirety.

BACKGROUND OF THE TECHNOLOGY

Field of the Technology

The present technology relates generally to flooring applications. More particularly, the present technology relates to flooring applications around or adjacent drains.

Related Art

Many traditional shower enclosures include a raised threshold, often termed a "curb," that retains water within the shower until the water can be drained out of the enclosure. While such curbs serve a useful purpose, they can present a barrier to entry for those with mobility challenges. Also, conventional designers often feel constrained by the need to incorporate such structure into bathroom designs, as it is thought that a more open design makes better use of available floor space.

For at least these reasons, so-called "curbless" or "barrier-free" shower designs are increasingly gaining in popularity. While the aesthetic appeal of such showers is understandable, installation of such showers can pose complications. One such problematic area is that a perimeter of the structure necessary to support and drain water from a curbless shower must be level with the surrounding subfloor to ensure that the shower tiles are installed at the same height as the surrounding floor tiles. This often necessitates reconfiguring the conventional subfloor to ensure that the shower tray is properly positioned relative to the surrounding subfloor: that is, that the shower floor slopes downward from an upper surface of the surrounding subfloor toward a drain.

SUMMARY OF THE TECHNOLOGY

In accordance with one aspect of the technology, a method is provided for supporting a recessed subfloor panel in a lowered position relative to an adjacent, primary subfloor, the primary subfloor being supported from beneath by one or more floor supports. The method can include positioning a spanning brace between a pair of floor supports and adjusting a length of the spanning brace such that the spanning brace engages and is supported by lateral, vertical sides of the pair of floor supports. A recessed subfloor panel can be supported atop the spanning brace, the recessed subfloor panel being supported at a lower elevation than an adjacent, primary subfloor.

In accordance with another aspect of the technology, a system is provided for supporting a recessed subfloor panel in a recessed position relative to an adjacent, primary subfloor. The system can include a lengthwise-adjustable spanning brace, the spanning brace being positionable between two lateral, vertical sides of a pair of floor supports. The spanning brace can include first and second opposing ends, each of the first and second ends being configured to engage the lateral sides of the floor supports such that vertical loads experienced by the spanning brace are transferred laterally to the floor supports.

In accordance with another aspect of the technology, a flooring installation is provided, including at least two floor supports separated from one another by a span distance, the at least two floor supports each having lateral, vertical side walls between which an opening is defined. A lengthwise-adjustable spanning brace can be disposed between the at least two floor supports, the spanning brace engaging on opposing ends the lateral, vertical side walls of the floor supports. A recessed subfloor panel can be supported atop the spanning brace, the recessed subfloor panel being supported at a lower elevation than an adjacent, primary subfloor.

In accordance with another aspect of the technology, a flooring installation is provided, including at least two floor supports separated from one another by a span distance, the at least two floor supports each having lateral, vertical side walls between which an opening is defined. A primary subfloor can be supported atop at least one of the at least two floor supports. A spanning brace can be disposed between the at least two floor supports. A recessed subfloor panel can be supported by the spanning brace, the recessed subfloor panel being supported at a lower elevation than the adjacent, primary subfloor. A lateral brace can have at least two shelf support legs defining therebetween a receiving channel, the receiving channel operable to receive therein one of: i) an edge of the primary subfloor panel or i) an end the spanning brace.

Various methods of installing, configuring, using, manufacturing and providing support brackets or braces and associated flooring components are also encompassed by the technology disclosed herein.

BRIEF DESCRIPTION OF THE DRAWINGS

The following drawings illustrate exemplary embodiments for carrying out the technology. Like reference numerals refer to like parts in different views or embodiments of the present technology in the drawings.

DETAILED DESCRIPTION

Figure 1:
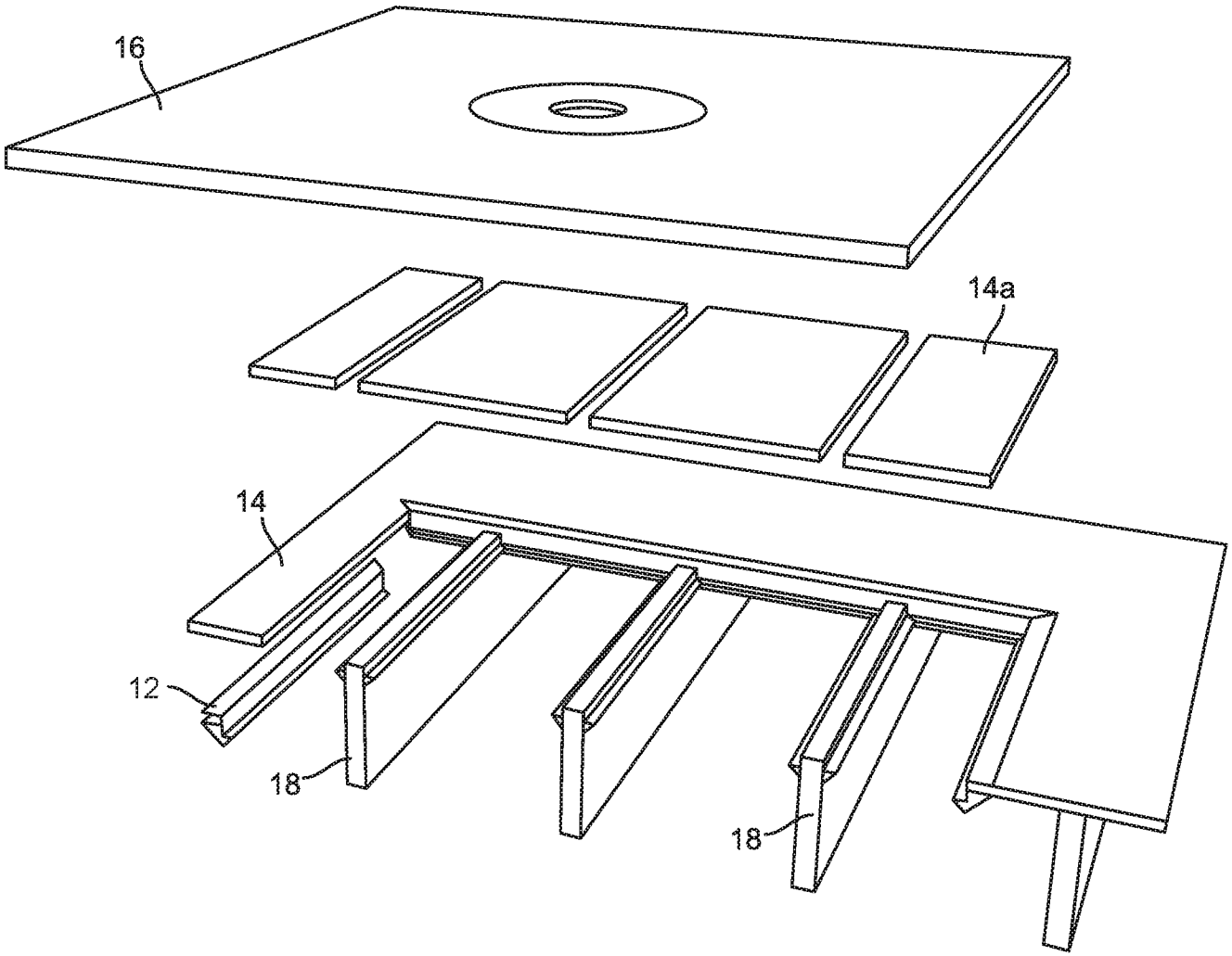
FIG. 1 is an exploded, perspective view of a flooring installation in accordance with an embodiment of the present technology.

Reference will now be made to the exemplary embodiments illustrated in the drawings, and specific language will be used herein to describe the same. It will nevertheless be understood that no limitation of the scope of the technology is thereby intended. Alterations and further modifications of the inventive features illustrated herein, and additional applications of the principles of the technology as illustrated herein, which would occur to one skilled in the relevant art and having possession of this disclosure, are to be considered within the scope of the technology.

Definitions

As used herein, the singular forms "a" and "the" can include plural referents unless the context clearly dictates otherwise. Thus, for example, reference to "a support bracket" can include one or more of such brackets, if the context so dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present technology. Such terms include, without limitation, "upward," "downward," "horizontal," "vertical," etc. These terms are generally not intended to be limiting, but are used to most clearly describe and claim the various features of the technology. Where such terms must carry some limitation, they are intended to be limited to usage commonly known and understood by those of ordinary skill in the art in the context of this disclosure. In some instances, dimensional information is included in the figures. This information is intended to be exemplary only, and not limiting. In some cases, the drawings are not to scale and such dimensional information may not be accurately translated throughout the figures.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to systems for modifying flooring structures to enable installation of so-called "barrier-free" or "curbless" showers in areas having traditional subfloor construction.

Figure 2:
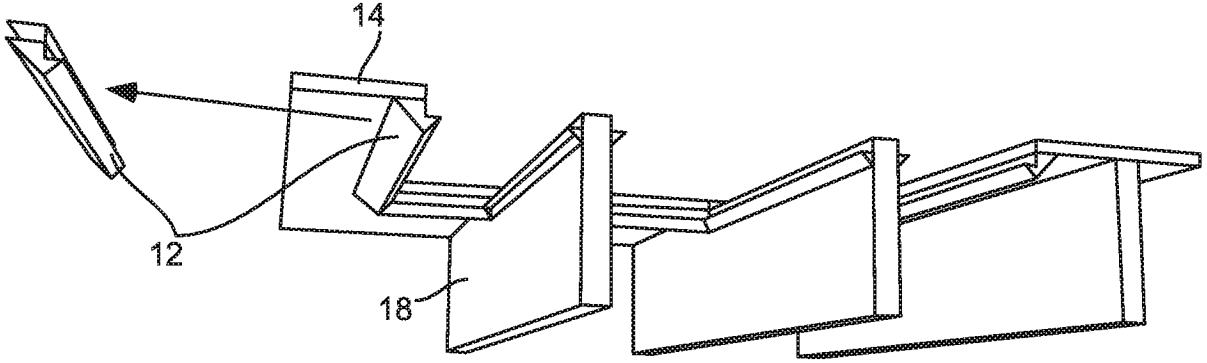
FIG. 2 is another exploded, perspective view of a flooring installation in accordance with an embodiment of the present technology.

FIGS. 1 and 2 illustrate exemplary components of one embodiment of the present system, shown in varying stages of installation. The components generally include one or more surrounding or primary subfloor panels 14 that have top surfaces that collectively define a surrounding subfloor elevation. The surrounding subfloor panels can be considered the equivalent of a conventional subfloor assembly, as such an assembly would typically be provided for any particular installation area. One or more floor supports 18, in this case floor joists, can have top surfaces arranged at an elevation below the surrounding or primary subfloor elevation. One or more support brackets 12 can each have at least one support shelf upon which one or more recessed subfloor panels can be supported. One or more shower tray panels 16 can be arranged atop the one or more recessed subfloor panels. Generally, an elevation of a top surface of the one or more shower tray panels is at least the same as an elevation of a top surface of the one or more primary subfloor panels, where adjoined with one another.

The present technology thus provides systems and methods by which recesses can be formed in conventional subfloor structures to allow shower tray panels to be installed with upper surfaces substantially level with the surrounding subfloor surface. This can allow installation of curbless or barrier-free showers with shower tray panels that are well supported to withstand the forces applied to such panels during ordinary use of the shower installation. The following discussion will focus on aspects of the technology utilized to remove or modify existing subfloor structures. It is to be understood, however, that the present technology can be utilized from the initial stages of building construction such that removal of any subfloor is not necessary: in other words, the present technology can be installed while or before the surrounding subfloor is installed.

FIGS. 3 through 13B illustrate various support brackets 12*a* through 12*j* for use in various locations or positions in a floor installation and for various subfloor configurations. In these embodiments, the support brackets can be specifically configured depending upon the available support features adjacent to or below the floor installation (e.g., floor joists, adjoining sill plates, surrounding concrete surfaces, wall studs, etc.).

Figure 3B:
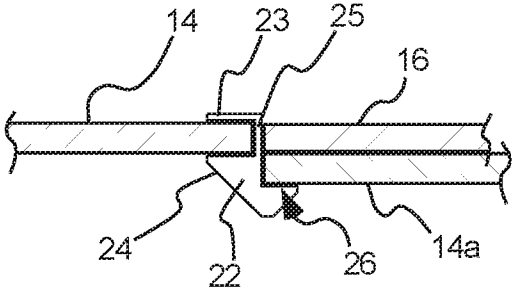
FIG. 3B is an end view of the support bracket of FIG. 3A as installed within a flooring installation.
Figure 3A:
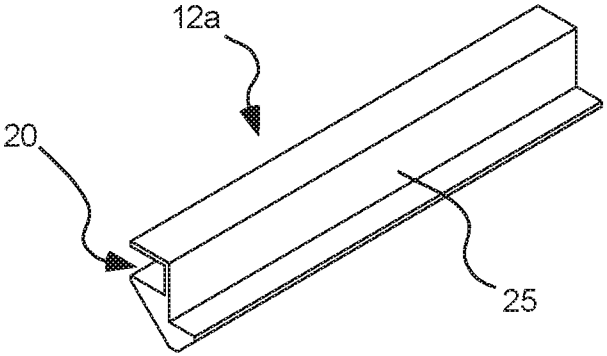
FIG. 3A is a perspective view of an exemplary support bracket in accordance with an embodiment of the present technology.

As shown in FIGS. 3A and 3B, for example, bracket 12*a* generally includes a support shelf 26 configured to receive thereon a recessed subfloor panel 14*a*. A shower tray panel 16 can be supported atop the recessed subfloor panel 14*a*. A receiving channel 20 can be provided that can be fit around the end of an adjoining primary subfloor panel 14. The receiving channel can be defined between a pair of opposing support shelfs or legs, for example, those shown at 21 and 23. A downwardly extending, generally vertical leg 25 can provide a vertical or elevational spacing between the support shelf 26 and the receiving channel 20.

The sizing and spacing of these various components is carefully configured to ensure that upper surfaces of the shower tray panel 16 and the adjoining or primary subfloor panel 14 are substantially or nearly the same elevation. This can allow seamless installation of a flooring product (e.g., tile or stone or vinyl, etc.) above and across (e.g., spanning) each of the subfloor panel and the shower tray panel without any variances in height of the flooring product.

In some embodiments, for example, in the case of bracket 12*a* (and brackets 12*f* and 12*h* discussed below), the brackets are configured to be free-floating, unsupported by any adjoining structure such as a floor joist, sill plate or the like. These support brackets can be used in locations where a surrounding subfloor panel terminates near a floor joist, but not near enough to support the end of the surrounding subfloor panel with the joist. This can be advantageous in locations where it may, for example, be undesirable or impractical to remove enough adjoining subfloor to reveal or gain access to a floor support or joist near this joint between surrounding subfloor panels and shower tray panels. To account for this lack of direct support at these locations, support brackets 12*a*, 12*f* and 12*h* can be provided with reinforcing structure 22 to limit or prevent downward or hinging movement of the support shelf 26 (and thus recessed subfloor panel 14*a*).

While the reinforcing structure 22 can take a variety of forms, in the example shown, the reinforcement comprises a thickened portion adjoining the support shelf, the thickened portion including a laterally and upwardly extending opposing leg 24 that transfers the load received by support shelf 26 upwardly into the lower surface of subfloor panel 14. As the edge of the subfloor panel is not as susceptible to twisting as the support bracket might otherwise be to bending, this opposing leg 24 limits bending or deformation of the support bracket in response to loading on the support shelf.

While the reinforcing structure 22 is shown in some views as a solid piece, it is to be understood that an empty space or void can be present between the opposing leg 24 and the vertical leg 25. Other or additional reinforcing structures can also be utilized, where desired.

Figure 4B:
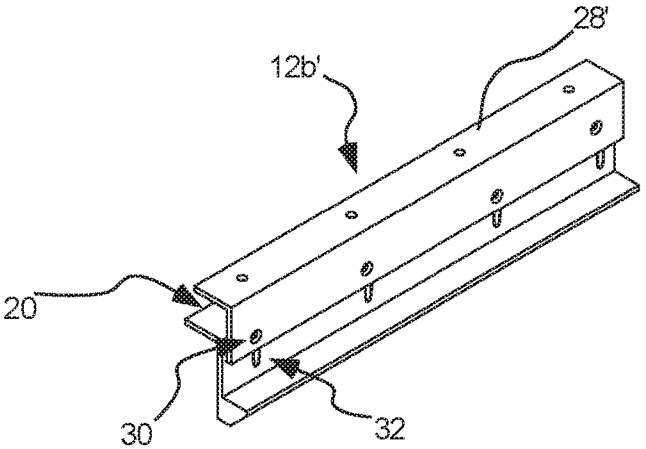
FIG. 4B is a perspective view of another embodiment of the support bracket of FIG. 4A.
Figure 4C:
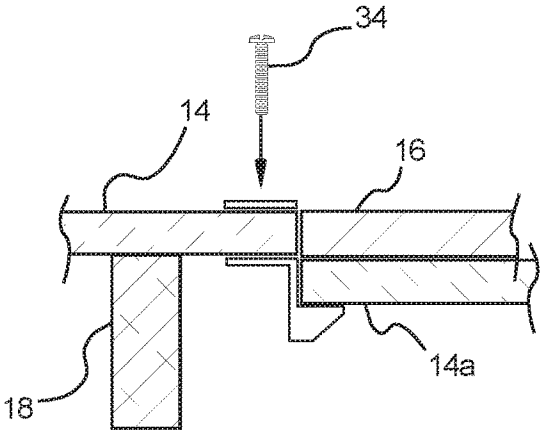
FIG. 4C is an end view of the support bracket of FIG. 4A as installed within a flooring installation.
Figure 4A:
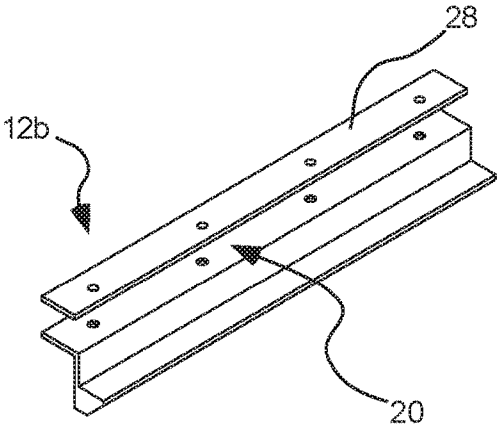
FIG. 4A is a perspective view of an exemplary support bracket in accordance with an embodiment of the present technology.

FIGS. 4A and 4C illustrate an additional support bracket 12*b* which, in this case, includes a separable brace 28 that can allow the height of the receiving channel 20 to be adjusted according to the thickness of the adjoining or surrounding subfloor panel 14. In this example, the bracket is configured to be secured above floor joist or support 18 by way of fastener 34 (e.g., a bolt) installed through the support bracket openings shown and into the lower support bracket structure. In the embodiment shown at 12*b*' in FIG. 4B, a separable brace 28' can include front holes 30 through which horizontal fasteners can be attached through slots 32 formed in the lower bracket or support. The horizontal fasteners can also include slidable rivets more or less permanently but moveably attached to the two components. These horizontal fasteners can ensure the two brackets are maintained in proper position relative to one another and can prevent the lower bracket from falling into the joist bay during installation. The "L" configuration of the upper bracket can also aid in preventing or limiting deflection. The slots can also provide a sight line by which fasteners 34 installed through the upper bracket can be aligned with corresponding holes in the lower bracket.

Figure 5B:
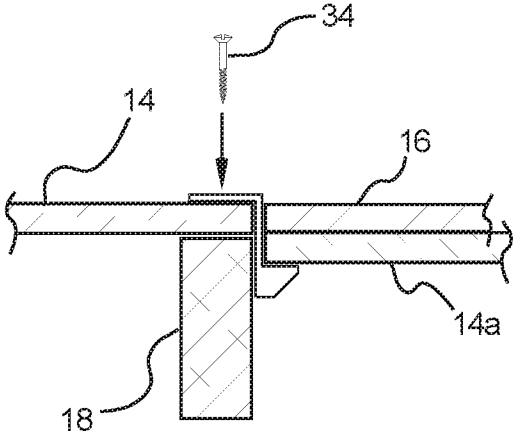
FIG. 5B is an end view of the support bracket of FIG. 5A as installed within a flooring installation.
Figure 5A:
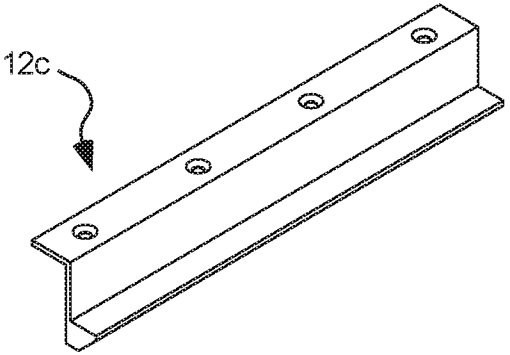
FIG. 5A is a perspective view of an exemplary support bracket in accordance with an embodiment of the present technology.
Figure 6A:
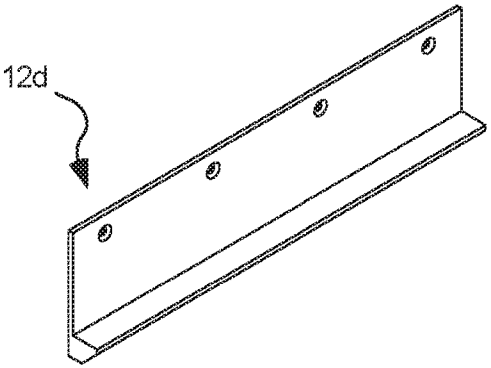
FIG. 6A is a perspective view of an exemplary support bracket in accordance with an embodiment of the present technology.
Figure 6B:
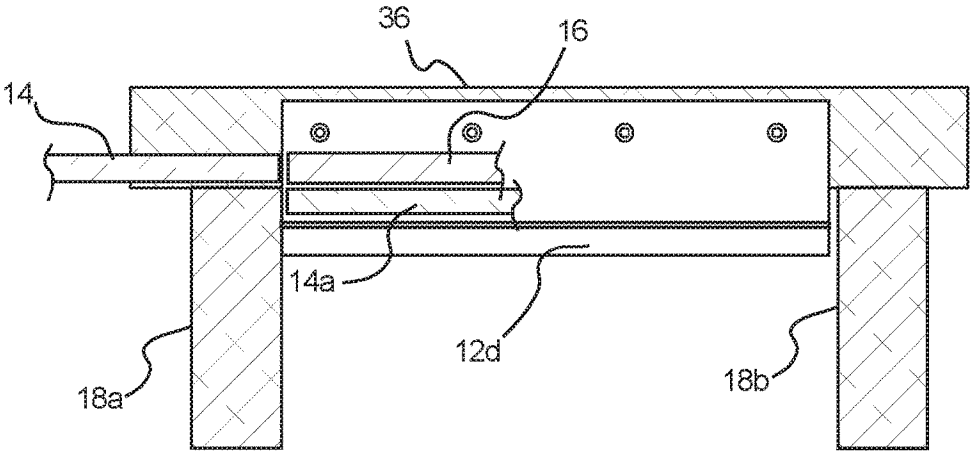
FIG. 6B is a front view of the support bracket of FIG. 6A as installed within a flooring installation.

FIGS. 5A and 5B illustrate bracket 12*c* having a fastener 34, in this case comprising a screw that can be driven through the subfloor panel 14 and into joist or support 18. FIGS. 6A and 6B illustrate a bracket 12*d* that can be installed adjacent a sill plate 36.

Figure 7B:
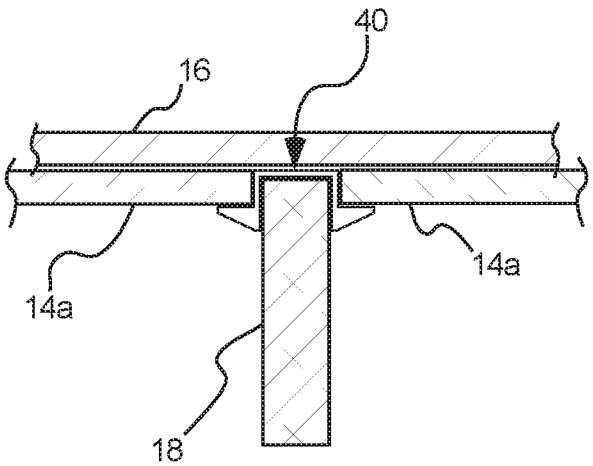
FIG. 7B is an end view of the support bracket of FIG. 7A as installed within a flooring installation.
Figure 7A:
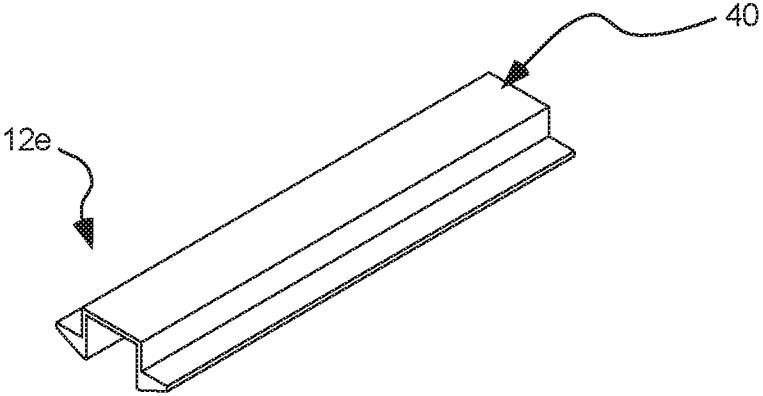
FIG. 7A is a perspective view of an exemplary support bracket in accordance with an embodiment of the present technology.
Figure 8B:
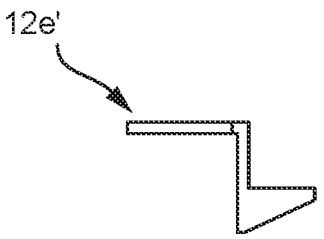
FIG. 8B is an end view of one of the support brackets of FIG. 8A.
Figure 8A:
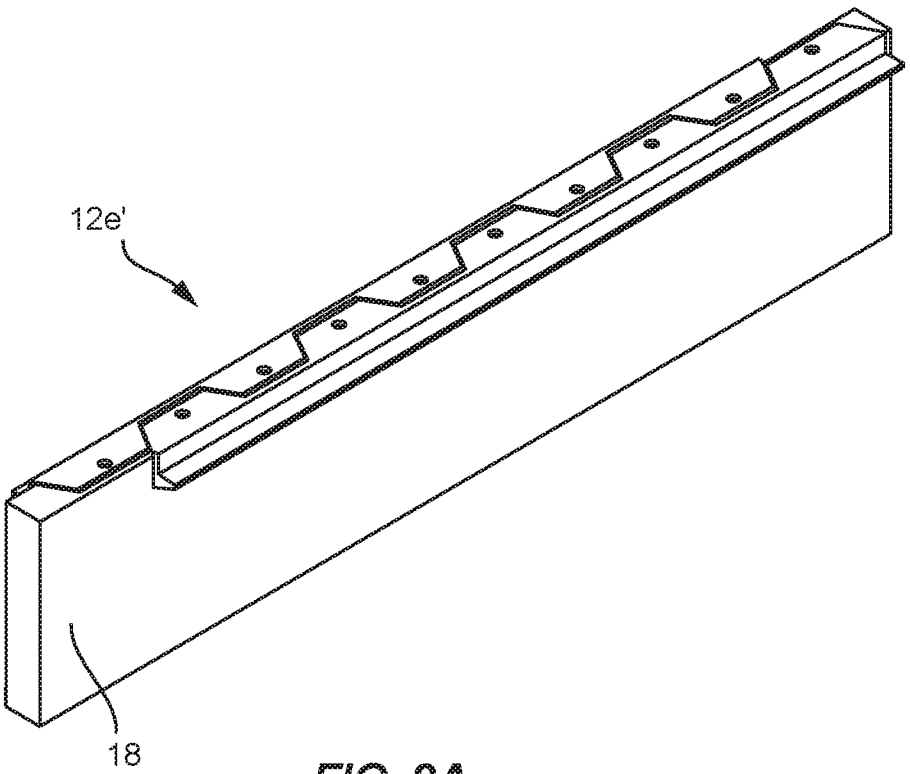
FIG. 8A is a perspective view of two paired support brackets in accordance with an embodiment of the present technology, installed atop a floor joist.

FIGS. 7A and 7B illustrate a support bracket 12*e* that can be utilized to straddle a floor joist or support 18. While the bracket 12*e* is shown as an integral unit, the bracket can be provided in two separable components that separate along upper edge 40. For example, as shown in additional embodiment 12*e*' in FIGS. 8A and 8B, the two sections can each be coupled atop the joist in varying locations (or varying degrees of "spread" between the two) and can thus allow for adjustment of the width of the saddle for differing sized joists or studs or trusses.

Figure 9A:
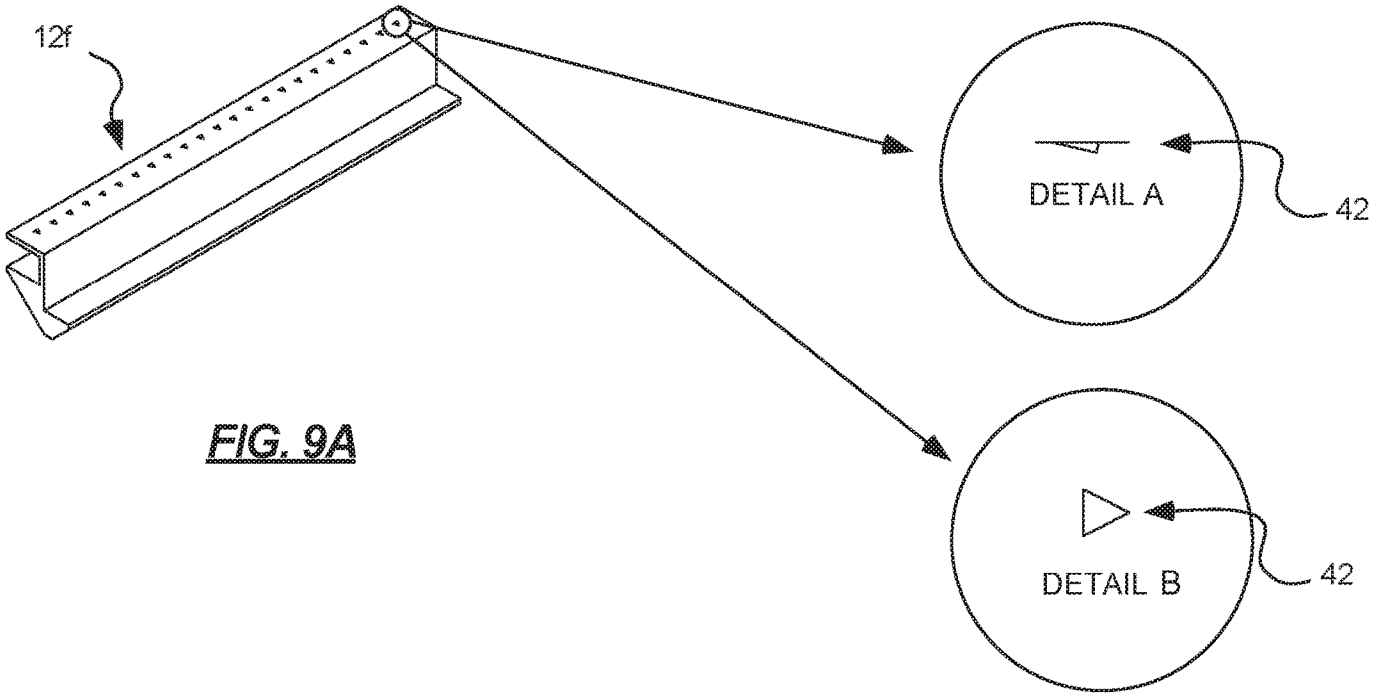
FIG. 9A is a perspective view of an exemplary support bracket in accordance with an embodiment of the present technology.
Figure 9B:
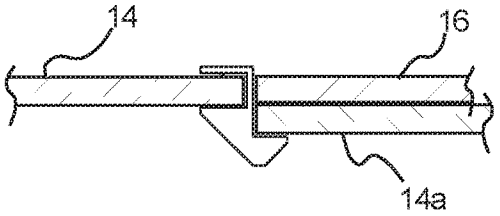
FIG. 9B is an end view of the support bracket of FIG. 9A as installed within a flooring installation.

FIGS. 9A and 9B illustrate bracket 12*f* that includes engagement features 42 that can aid in retaining contact between the support bracket and the adjoining subfloor panels 14. Such features can take the form of punched teeth (similar to those found in truss nail plates) that allow the bracket to slip onto a subfloor panel but resist removal of the bracket once positioned around the subfloor panel. These features can advantageously prevent creep of the bracket relative to the surrounding subfloor panel over time.

Figure 10B:
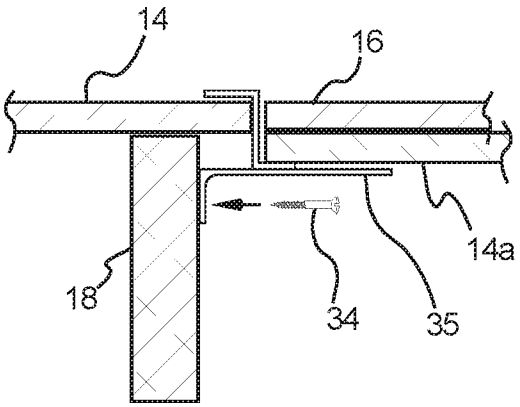
FIG. 10B is an end view of the support bracket of FIG. 10A as installed within a flooring installation.
Figure 10A:
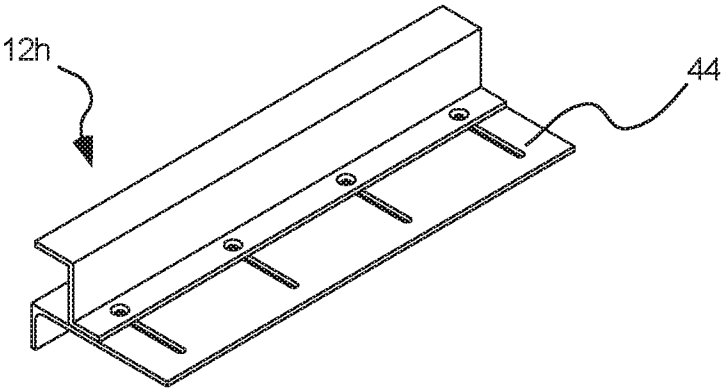
FIG. 10A is a perspective view of an exemplary support bracket in accordance with an embodiment of the present technology.

FIGS. 10A and 10B illustrate an embodiment of the technology in which bracket 12*h* includes a slidable shelf support leg 35. The shelf support leg can be securely mounted to joist or support 18, and the remaining bracketry of the support bracket can slidably adjust relative thereto. This embodiment allows installation of the bracket near a floor joist while allowing minor adjustments in distance therefrom. This can be advantageous when a subfloor panel terminates a small distance from a joist. This (and similar brackets shown elsewhere herein) can be particularly advantageous in that it is often not convenient or possible for an installer to cut (in order to remove) subfloor panels directly against structures such as bottom plates, sole plates, sill plates, etc. Due to the width, for example, of circular saw bodies, it may not be possible or convenient to cut directly against such structure. In this case, a short piece of surrounding subfloor may be "hanging" a few inches from such structure: in this case, bracing such structure can be easily and securely accomplished utilizing the bracket(s) shown.

Figure 11B:
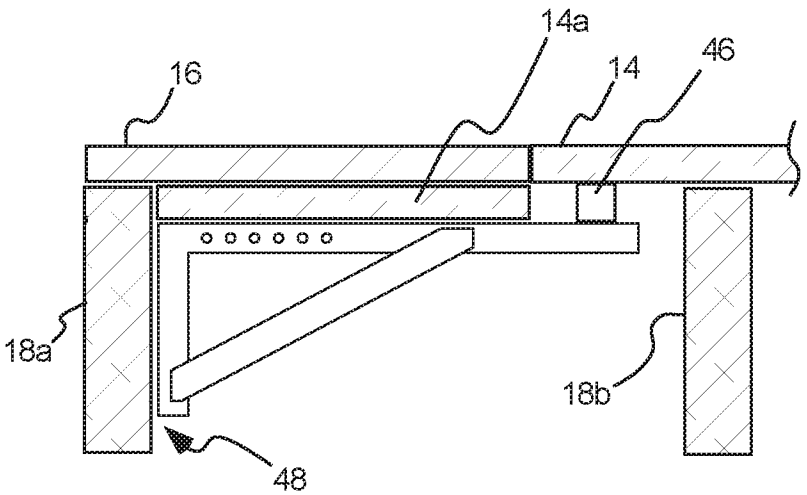
FIG. 11B is a side view of the support bracket of FIG. 11A as installed within a flooring installation.
Figure 11A:
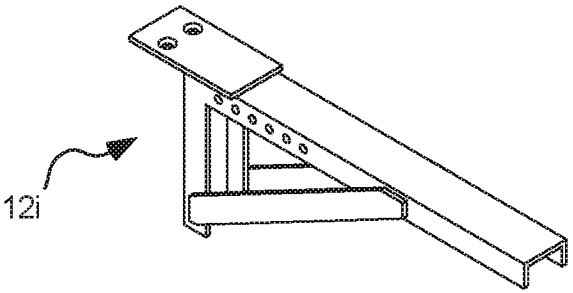
FIG. 11A is a perspective view of an exemplary support bracket in accordance with an embodiment of the present technology.

FIGS. 11A and 11B illustrate a bracket 12*i* for use in spanning a relatively large distance from one joist 18 to another. This bracket is advantageous in situations where shower tray panel 16 and surrounding subfloor panel 14 adjoin at a location far removed from the leftmost joist 18*a*, and where access to the rightmost joist 18*b* is limited. In this case, bracket 12*i* can be coupled to joist 18*a* and can extend beneath the location where the two panels meet to thereby securely surrounding support subfloor panel 14. A spacer block 46 can be provided on the extension leg to provide support to panel 14. While not shown in detail, lower portions of the vertical leg, near reference numeral 48, for example, can be provided with cleats or engagement spikes that engage joist 18 to prevent the vertical leg from being pulled away from the joist.

Figure 11C:
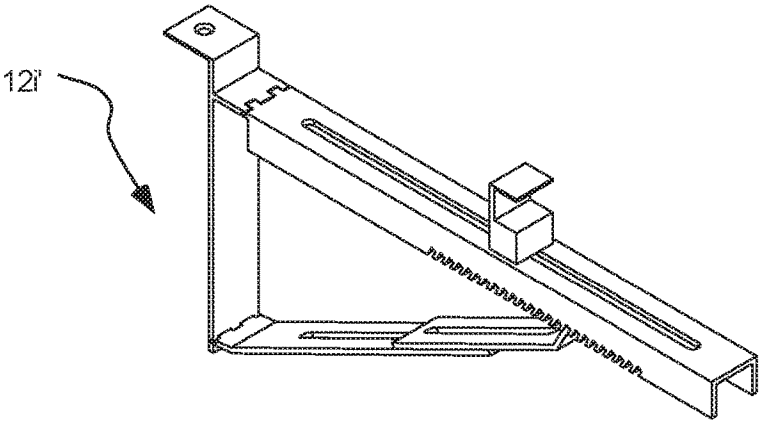
FIG. 11C is a perspective view of an exemplary support bracket in accordance with an embodiment of the present technology.
Figure 11D:
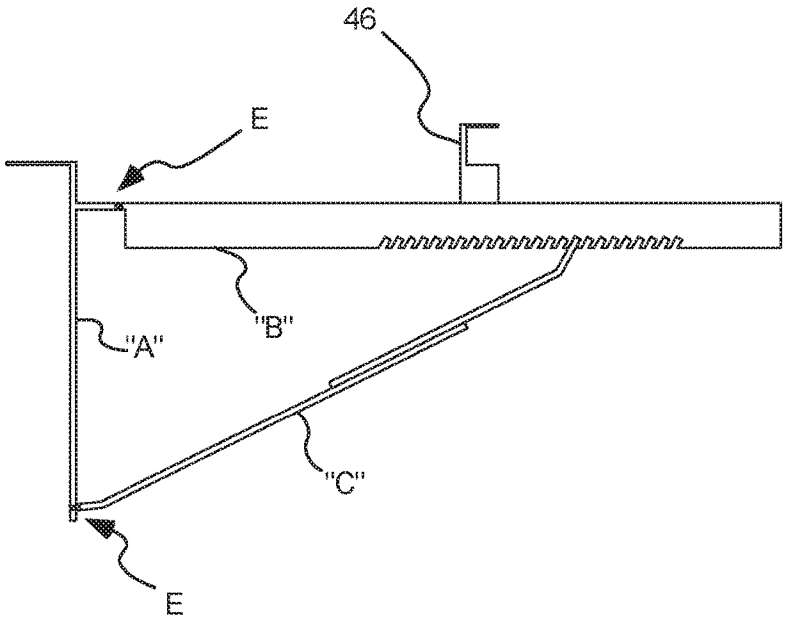
FIG. 11D is a side view of the support bracket of FIG. 11C.
Figure 11E:
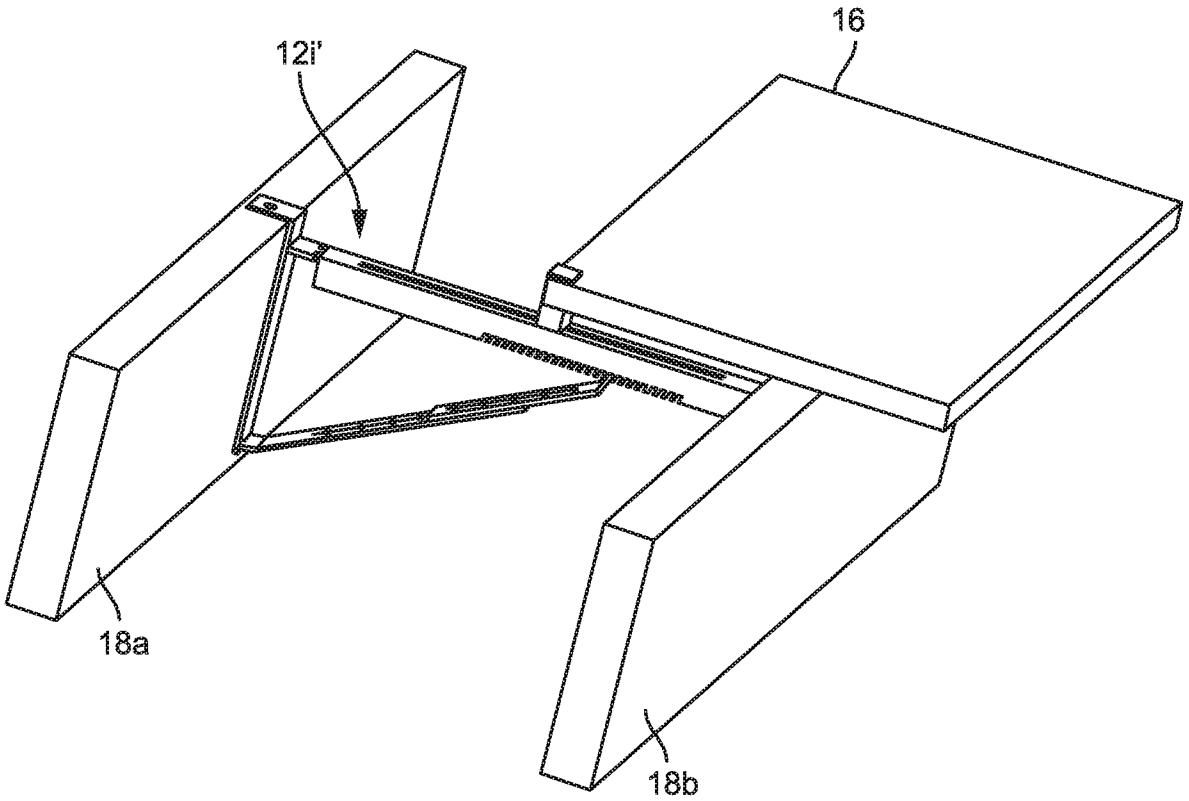
FIG. 11E is a perspective view of a section of a flooring installation with an exemplary support bracket installed therein.

FIGS. 11C, 11D and 11E illustrate an additional embodiment of bracket 12*i*' similar to that shown in FIGS. 11A and 11B. In this embodiment, legs "A," "B" and "C" are configured as an adjustable brace. Hinges "E" can be provided at the junction of legs A-B and A-C to allow angular adjustment of the legs relative to one another. Adjustable teeth can be provided on leg "B," so that a tongue formed on leg "C" can be secured to leg "B" at varying locations. These features can be advantageous for applications in which the various components are not level with one another: the adjustable feature can allow adjustment of the support bracket to account for misalignment.

In another example, not shown in detail in the figures, legs B-C can be hinged relative to one another, and leg "C" can be formed to include telescoping features. Adjustment of the length of the telescoping features can achieve adjustment of the height of leg "B."

Figure 12A:
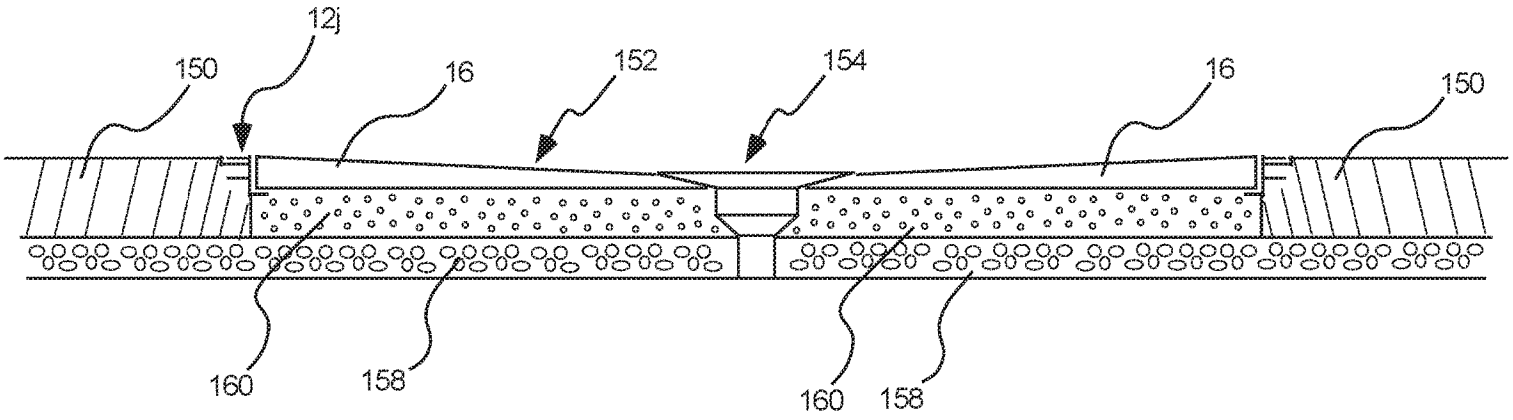
FIG. 12A is a side view of an exemplary support bracket usage in an exemplary concrete floor installation.

FIGS. 12A through 13B illustrate features of the technology for use with concrete subfloors. FIG. 12A illustrates a concrete subfloor 150 within which a recess 152 has been formed. A drain 154 can be located within the recess. FIGS. 12A and 13A illustrate two exemplary shower tray panel installations that can be located within the recess 152. In the example of FIG. 12A, the shower tray panel 16 is generally thicker than in the example of FIG. 12B, on the order of 1.5 inches or larger. In FIG. 13A, the shower tray panel 16*t* is generally thinner: on the order of 1.0 inches or less. The installation can include gravel bed 158, mortar bed 160, concrete subfloor 150, shower tray panel 16 and support bracket 12*j*.

Figure 12B:
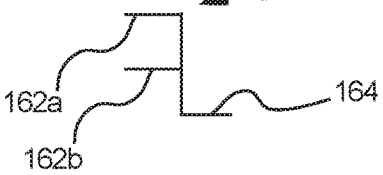
FIG. 12B is an end view of the support bracket of FIG. 12A.
Figure 13A:
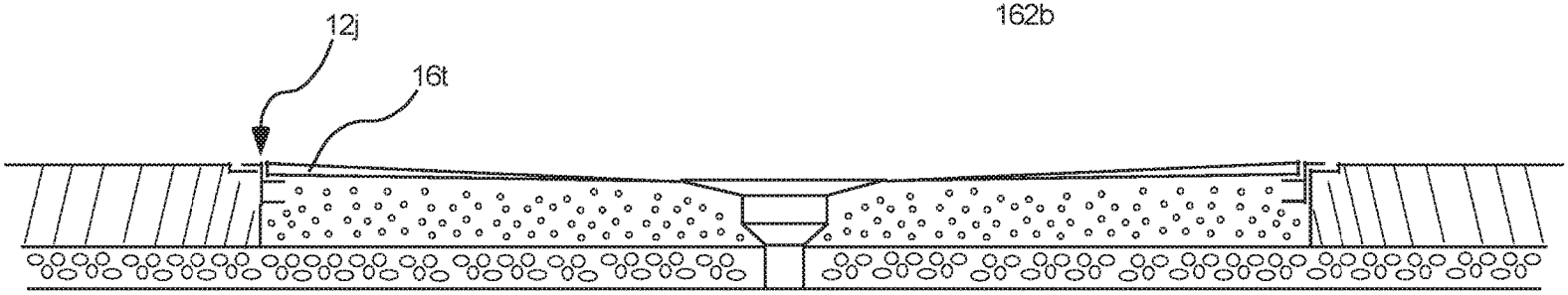
FIG. 13A is a side view of an exemplary support bracket usage in an exemplary concrete floor installation.
Figure 13B:
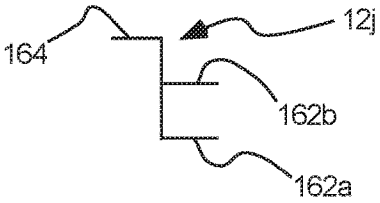
FIG. 13B is an end view of the support bracket of FIG. 13A.

In these examples, support bracket 12*j* can include a variable-use configuration: in the example of FIGS. 12A and 12B, with a thicker shower tray panel 16, a pair of upper legs 162*a*, 162*b* can extend into the concrete of the concrete subfloor to secure the bracket 12*j* thereto. A lower leg 164 can extend in an opposing direction and can serve to support the shower tray panel 16. In the example of FIGS. 13A and 13B, the support bracket 12*j* can be rotated such that leg 164 is secured in the concrete of the subfloor, with leg 162*b* serving as a support shelf on which the shower tray panel can be supported. Bracket 12*j* can also serve as a screed point to ensure the correct dimensions are maintained during formation of the recess.

While the support bracket 12*j* is shown with one or more legs formed within the concrete subfloor, the bracket can readily be reconfigured to provide a mounting interface that can allow the bracket to be secured to the concrete within the recess in a variety of manners (e.g., threaded fasteners and/or adhesives, etc.).

Figure 14A:
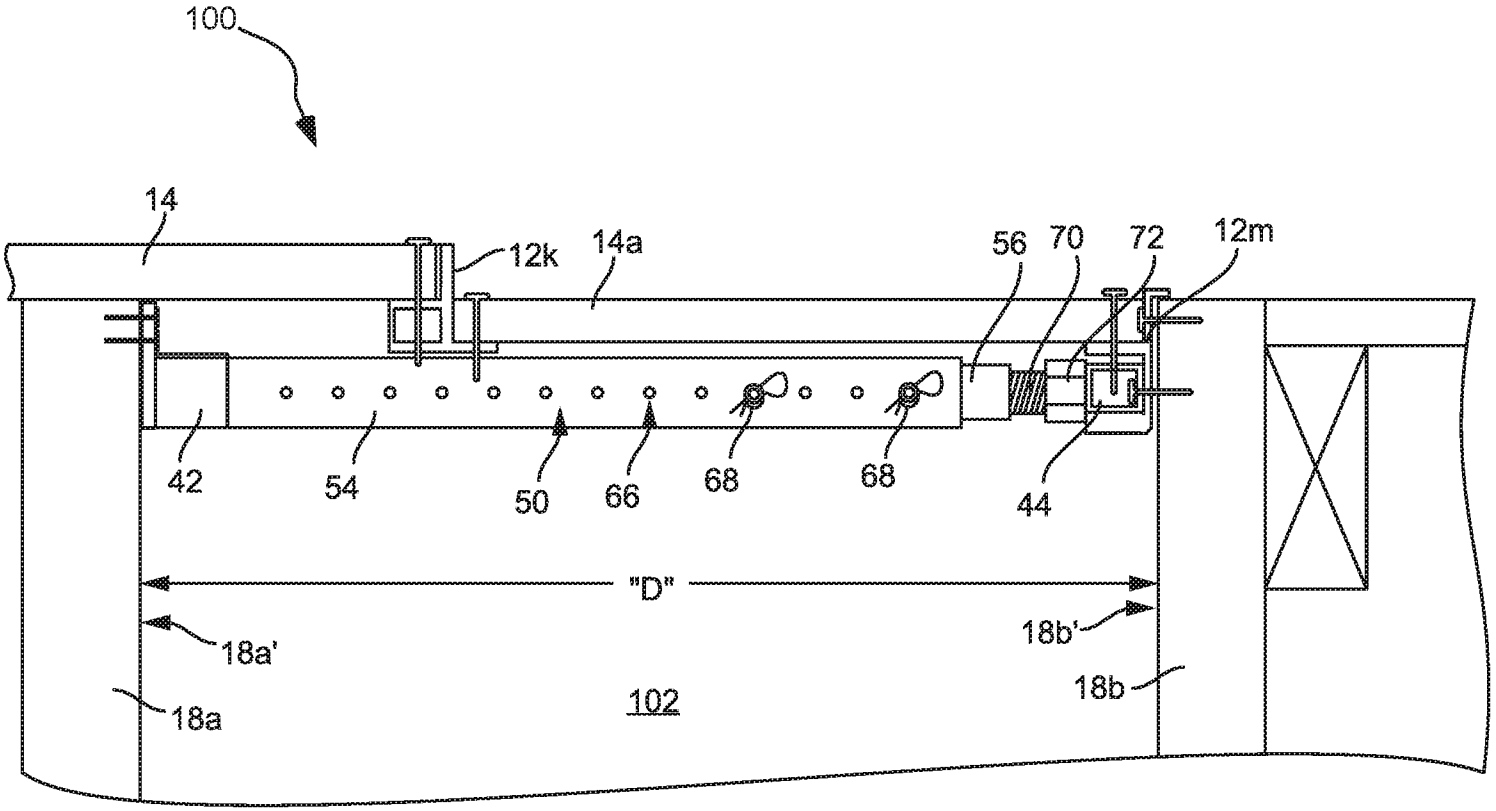
FIG. 14A is a side view of a flooring installation illustrating an embodiment of the present technology installed within a subfloor.

FIG. 14A illustrates another exemplary implementation of the present technology. In this figure, a flooring installation 100 is shown that can include at least two floor supports 18*a*, 18*b* separated from one another by a span distance "D." The at least two floor supports can be configured in a number of manners, but generally serve to support a primary subfloor 14 in the well-known manner. The floor supports can be joists, trusses, dimensional lumber, engineered beams (such as I-beams), etc. As that term is used herein, a floor support can also include a structure adjacent conventional joists or beams, such as an interior wall, foundation wall, etc. Each of the floor supports can include lateral, vertical side walls 18*a*', 18*b*' between which an opening or "bay" 102 is defined.

A lengthwise-adjustable spanning brace 50 can be disposed between the at least two floor supports 18*a*, 18*b*. The spanning brace engages on opposing ends the lateral, vertical side walls 18*a*', 18*b*' of the floor supports in such a manner that vertical loads experienced by the spanning brace (e.g., by the recessed subfloor panel 14*a* supported by the spanning brace) are transferred laterally to the floor supports. A recessed subfloor panel 14*a* can be supported atop the spanning brace at a lower elevation than the adjacent, primary subfloor 14.

The recessed subfloor panel 14*a* can take a variety of forms, but is often formed from the same material as is the surrounding primary subfloor 14. Generally, the recessed subfloor panel will include a height or thickness equal to a height of the surrounding primary subfloor. Thus, an upper surface of a ¾ inch recessed subfloor panel will be positioned ¾ of an inch below the upper surface of a ¾ inch primary subfloor. Generally the recessed subfloor panel will include a width equal to or smaller than the span distance "D" between two floor supports 18*a*, 18*b*.

In the example shown, primary subfloor 14 extends over the leftmost floor support or joist 18*a* and terminates above the bay 102. Note that the view shown in FIG. 14A is an end, sectional view—the subfloor and recessed subfloor panel generally prevent access to the bay except for via the overhang space. Conventional methods of recessing subfloors have proved ineffective at supporting the end of the primary subfloor above this empty space. Depending on how far toward the floor support 18*b* the primary subfloor extends, an installer may have very little room between the rightmost end of the primary subfloor 14 and the floor support 18*b* to access the floor support 18*a*. In this case, securely attaching structure to this "blind" (e.g., difficult to access) floor support 18*a* can be very difficult, if not impossible, using conventional systems. The present technology addresses these limitations with a number of unique solutions.

In the example shown, the spanning brace 50 includes one or more endcaps 42, 44 that can be interchangeably coupleable to the ends of the spanning brace. Endcap 42 can include an opening 62 (FIG. 15) in which an end of the spanning brace can be received. Endcap 42 can also include one or more fasteners 64 (FIGS. 15-17) that can be used to secure the endcap to the vertical sides 18*a*', 18*b*' of the floor supports 18*a*, 18*b*. The fasteners can take a variety of forms. In one embodiment, shown by example in FIGS. 16 and 17, the fasteners can be strike fasteners that are partially moveable relative to the endcap 42*a* and can be driven into the lateral sides of the floor supports with a tool suitable for use in confined spaces, such as a slide nailer or the like (not shown).

Figure 15:
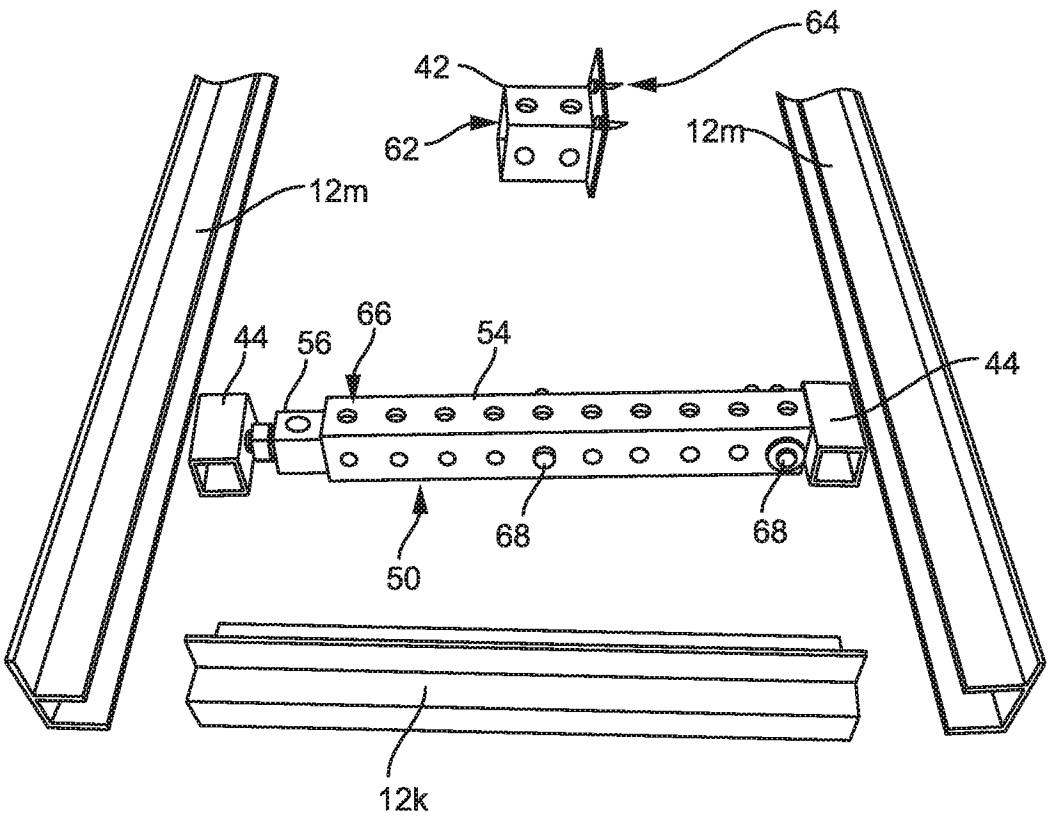
FIG. 15 is a perspective view of various components in accordance with the present technology for recessing a portion of a subfloor.

In the embodiment shown in FIGS. 14A and 15, endcap 42 can include one or more fasteners 64 in the form of cleats that are rigidly fixed to or formed integrally with the endcap. These can be secured to the sidewalls 18*a*', 18*b*' of the floor supports 18*a*, 18*b* by mechanically forcing the cleats into the sidewalls through pressure applied to the endcap. This can be advantageous in embodiments in which very little access can be gained to floor supports 18 (e.g., in which the primary subfloor 14 extends a great deal over the bay 102). The arrangement of the spanning brace 50 illustrated in FIG. 14A, for example, provides a manner of accomplishing this, as discussed in further detail below. Adhesive can also be applied between the endcap 42, 42*a* and the vertical sides of the floor supports to increase the strength of the interface between the two components.

Figure 16:
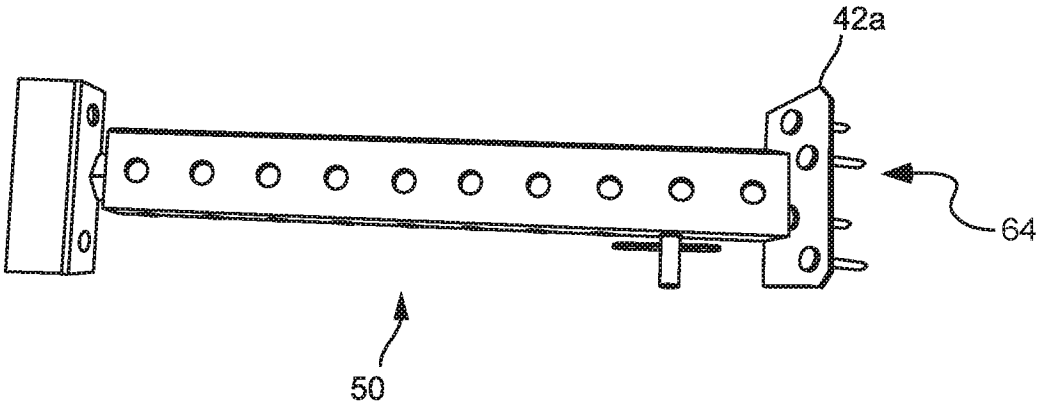
FIG. 16 is a top view of some of the components of FIG. 14A shown in an assembled, contracted condition.
Figure 17:
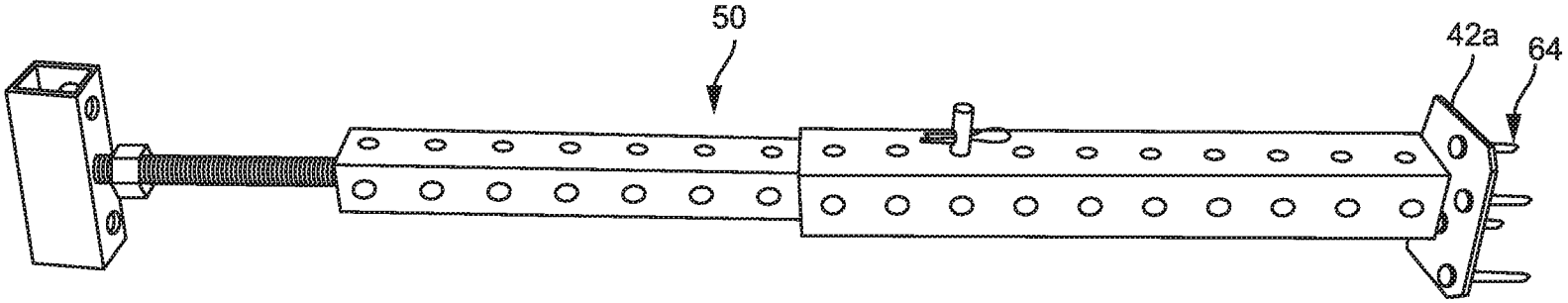
FIG. 17 is a top view of the assembly of FIG. 16, with the assembly extended.

In the example shown, the spanning brace 50 can include an inner arm 56 that can be slideable within an outer arm 54. A series of openings or holes 66 can be formed in each of the inner and outer arms through which pins 68 can be fitted. The inner and outer arms can be adjusted to a macro length just short of span distance "D" (sufficiently short of engaging the sidewalls so that fasteners 64, where used, do not engage the sidewalls 18*a*', 18*b*'). Once this macro length adjustment is achieved, the pins can be fitted in the openings to fix the outer and inner arms relative to one another. A threaded rod 70 can be rotatably attached to inner arm 56 such that rotation of the threaded rod causes the overall length of the inner arm to be adjusted. A nut or other engagement feature 72 can be fixed relative to the threaded rod. Adjustment of the nut causes an overall length of the spanning brace to be adjusted on a micro scale. FIG. 16 illustrates the macro and micro adjustment mechanisms contracted to a smallest dimension. FIG. 17 illustrates the macro and micro adjustment mechanisms extended to a larger, extended dimension.

In use, the macro length of the spanning brace 50 can be adjusted and one or more ends of the spanning brace can be positioned near one or both sidewalls 18*a*', 18*b*'. Once so positioned, nut 72 can be rotated to adjust the micro length of the spanning brace, which in turn forces cleats 64 securely into one or both of the sidewalls of the floor supports 18*a*, 18*b*. As the nut can be accessed from above through a relatively thin space or opening, the spanning brace can be installed and secured even in applications in which the space between a rightmost end of the primary subfloor 14 and the rightmost floor support 18*b* (FIG. 14A) is very small. Once the cleats are securely engaged with the floor support(s), vertical loads experienced by the spanning brace are transferred laterally into the floor supports. The recessed subfloor panel 14*a* can then be installed upon the spanning brace and loads carried by the recessed panel can be transferred into the floor supports. The present technology has proved very effective at carrying loads experienced by the recessed subfloor of at least 50 pounds per square foot (lbs./ft$^2$), with a live load capacity of at least 40 lbs./ft$^2$ and a dead load capacity of at least 10 lbs./ft$^2$. These capabilities meet or exceed all known standards promulgated for such installations.

In addition to the endcap 42 having fasteners associated therewith, the system can also include one or more lateral braces 12*k*, 12*m*, etc. that can be coupleable to the lateral, vertical sides 18*a*', 18*b*' of the floor supports 18*a*, 19*a*. The lateral braces can cooperate with ends of the spanning brace 50 to secure the spanning brace relative to the floor supports. Lateral brace 12*m* can typically be used when the lateral, vertical sides of the floor supports can be relatively easily accessed, so that the lateral brace can be easily fastened into the sides of the floor supports using known screws, bolts, adhesives, etc.

Figure 14B:
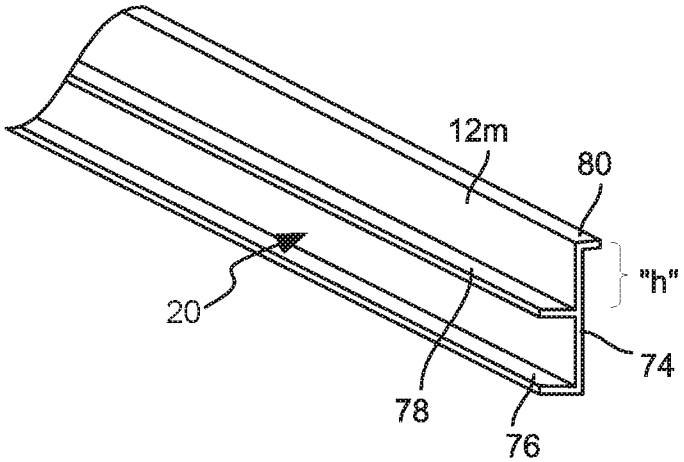
FIG. 14B is a perspective view a support bracket of the flooring installation of FIG. 14A.

As best shown in FIG. 14B, lateral bracket or brace 12*m* can include a vertical arm 74 from which a lower horizontal arm, shelf or leg 76 and an upper horizontal arm, shelf or leg 78 can extend. An endcap of the spanning brace 50 can be fitted between a receiving channel 20 defined between the horizontal arms 76, 78 and thereby secured vertically. Alternately, an end of the spanning brace, without any particular endcap structure attached thereto, can be held in the receiving channel between the horizontal arms. The recessed subfloor panel 14*a* can be secured to the upper surface of horizontal arm 78. The lateral brace can include structure that extends above the horizontal arm 78 at a specified distance "h" such that installation of the lateral support with the top of the vertical arm 74 flush with the top of the floor support automatically positions the horizontal arm 78 at the proper height. That is, securing the recessed subfloor panel to the horizontal arm 78 results in the top surface of the recessed subfloor panel being flush with the top surface of the floor support.

A vertical stop 80 can optionally be formed on the upper portion of the lateral brace 12*m* to serve as an aid in properly aligning the brace with the upper portion of the floor support 18*a*, 18*b*. This vertical stop can be formed very thin, on the order of 1/16 of an inch, as it need not carry a great deal of load—it need only support the lateral brace in position prior to fixing the lateral brace to the floor support. Forming the vertical stop with a very thin profile can limit or prevent the vertical stop from significantly interfering with a height of a tile or other structure installed above the vertical stop. This vertical stop can also be included on bracket or brace 12*k* (FIG. 14C), where desirable.

Figure 26:
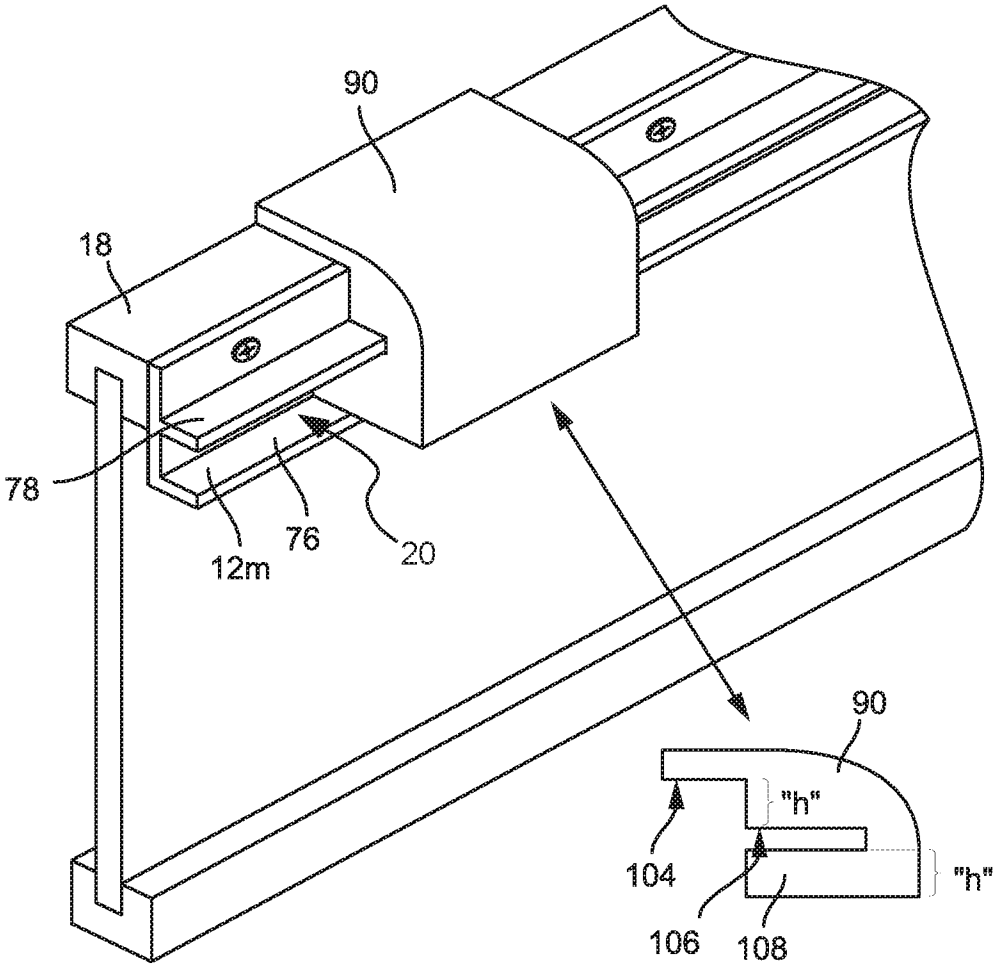
FIG. 26 is a perspective view of an installation in which an alignment tool is being used to align a lateral brace in accordance with another aspect of the technology.

FIG. 26 illustrates an alternate manner of aligning a lateral brace. In this example, an alignment tool 90 is provided by which lateral brace 12*m* can be properly aligned with floor support 18. The alignment tool includes an upper shelf support surface or leg 104 that can be temporarily oriented atop the floor support 18. When the upper shelf support is supported by the top of the floor support, a lower shelf support surface or leg 106 of the alignment tool is positioned a distance "h" below the top of the floor support. When the upper horizontal arm 78 of the lateral brace is positioned against the upper shelf support surface 104, a recessed subfloor panel or brace held atop the upper 78 horizontal arm is automatically properly positioned flush with the adjoining top of the floor support 18. Thus, the alignment tool can be used to quickly and accurately align various components one with another to allow efficient installation of the various components of the system.

In one embodiment, the alignment tool 90 can include an extension 108 that includes a thickness "h." This extension can be sized such that it easily and snugly fits within the receiving channel 20 in the lateral brace 12*m* created between horizontal arms 76 and 78. Thus, an installer can insert one or more alignment tools in this channel or gap and it will be temporarily held therein. The installer can then simply position the upper shelf support surface 104 upon the top of the floor support 18 and the lateral brace is automatically positioned correctly relative to the floor support. The installer can then couple the lateral brace to the floor support, after which the alignment tool can be easily slid within the lateral brace to an alternate position, or removed from the lateral brace. The alignment tool can be discarded or reused after use, as desired.

In the embodiments shown, the recessed subfloor panel 14*a* is carried directly atop the spanning brace 50. In some embodiments, however, the spanning brace can carry additional structure, such as leveling blocks or spacing blocks (analogous to that shown at 46 in FIG. 11B) that can form a load carrying profile atop which the recessed subfloor panel can be installed. For example, a plate, or several plates, can be carried by an upper portion of the spanning brace to better support the recessed subfloor panel or to adjust a height above the spanning brace at which another structure is supported. While the spanning brace is shown generally rectangular cross-section, it is understood that other configurations can also be used, such as more rounded cross-sections.

Figure 21A:
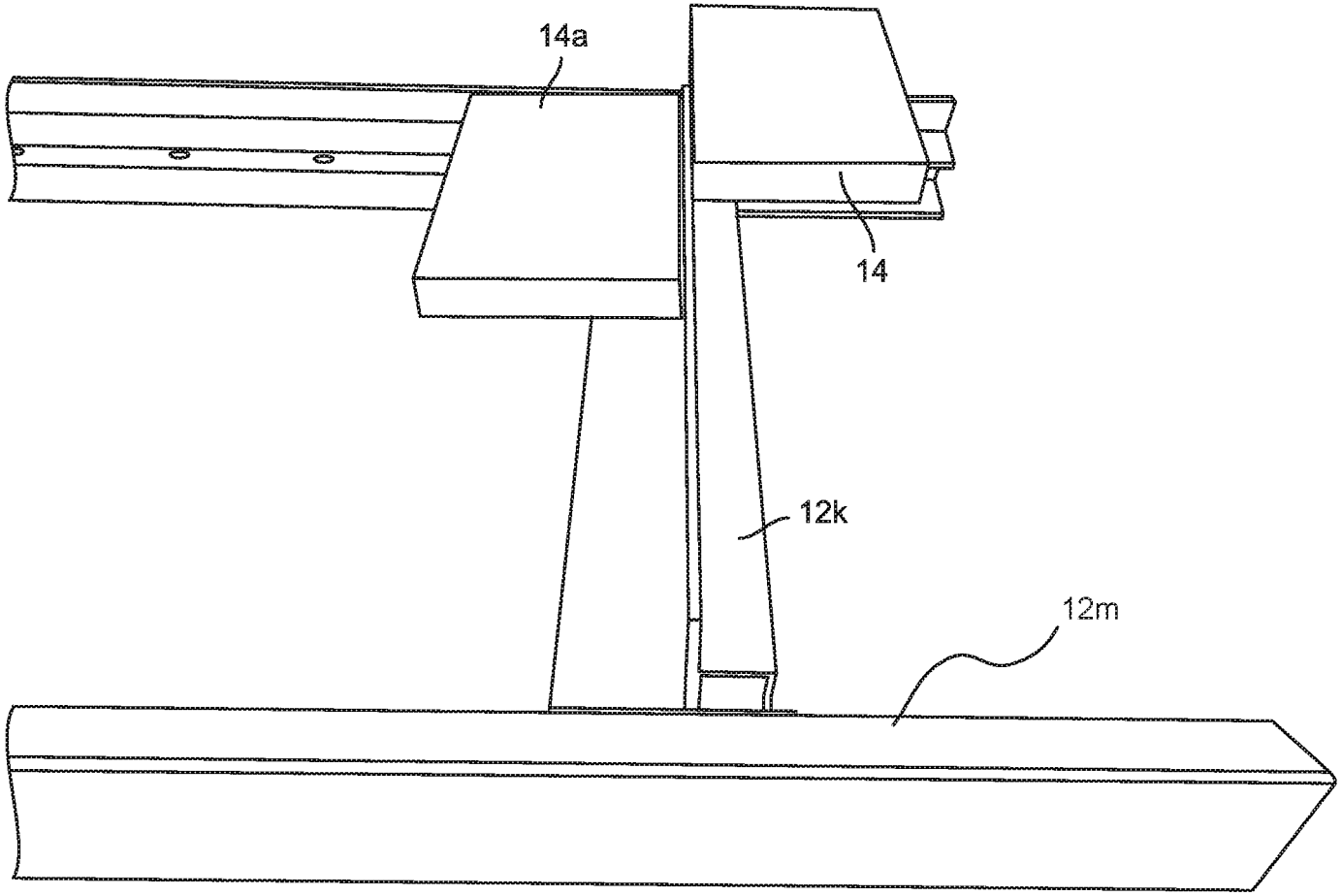
FIG. 21A is a perspective, side view showing assembly components as they interact with exemplary subfloor components.
Figure 21B:
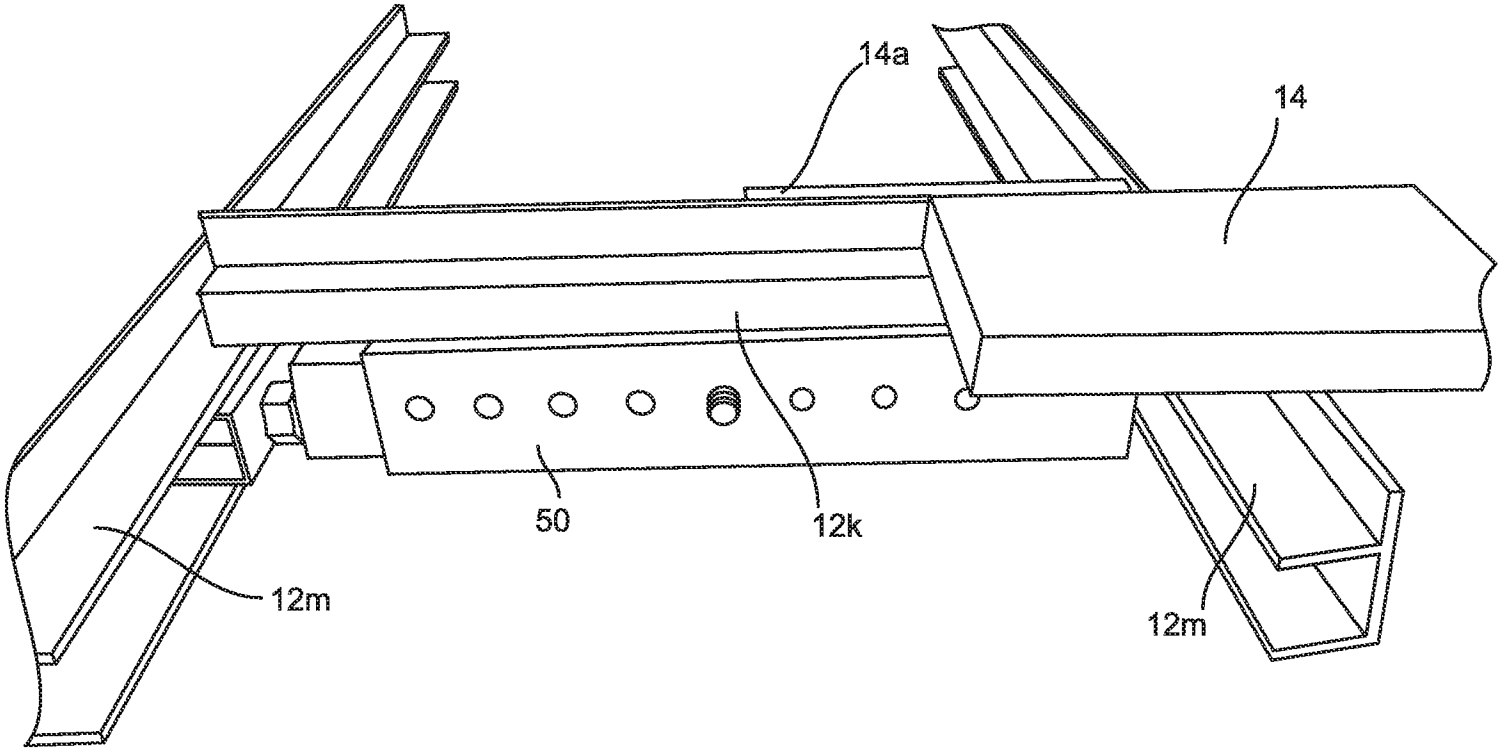
FIG. 21B is an end view of the assembly of FIG. 21A.

The present system also includes an end bracket or brace 12*k* that is generally intended to provide support to ends of subfloor members (either recessed or primary) beneath which no floor support is available. This can be the case in both the situation in which the unsupported end of the subfloor runs parallel to the floor supports, as shown in FIG. 14A, or in which the unsupported end of the subfloor runs generally perpendicularly to the floor supports, as is shown for example in FIGS. 21A and 21B. In other words, the end brace can extend perpendicularly to the spanning brace 50 (FIG. 14A) or parallel to the spanning brace (FIG. 21A).

Figure 14C:
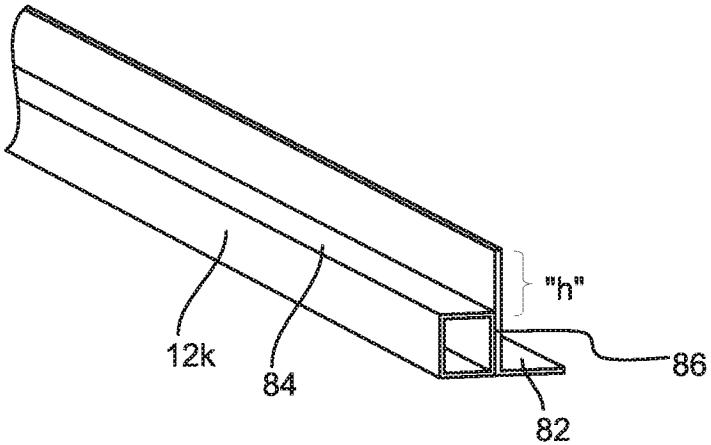
FIG. 14C is a perspective view a support bracket of the flooring installation of FIG. 14A.

As shown in more detail in FIG. 14C, the end brace 12*k* can include a lower horizontal shelf support surface or leg 82 connected to an upper horizontal shelf support surface or leg 84 by vertical upright 86. The end brace can include vertical structure that extends above the upper horizontal shelf support surface by a distance "h," which can correspond to a height of the recessed subfloor panel 14*a*. In this manner, positioning an uppermost portion of the end brace at the level of the primary subfloor automatically correctly positions the height of the upper and lower support surfaces in order to support the primary and recessed subfloor panels at the proper height.

Figure 18B:
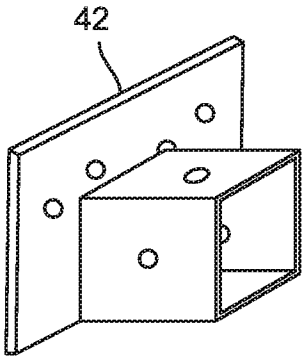
FIG. 18B is a perspective view of another endcap in accordance with an embodiment of the technology.
Figure 18A:
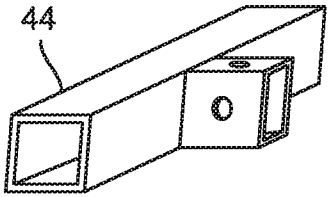
FIG. 18A is a perspective view of an endcap in accordance with an embodiment of the technology.
Figure 19:
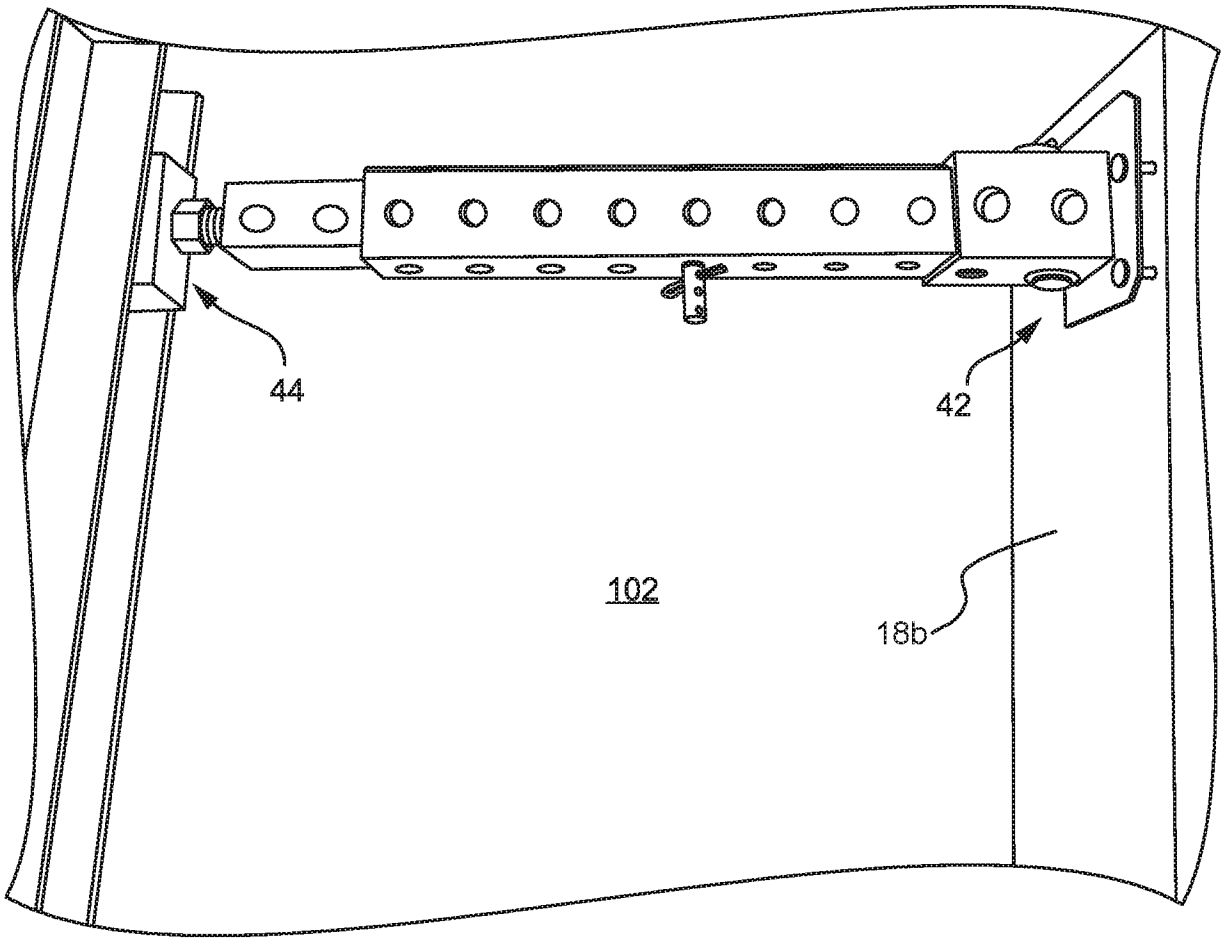
FIG. 19 is a top view of a section of a flooring assembly in accordance with an embodiment of the technology.
Figure 20:
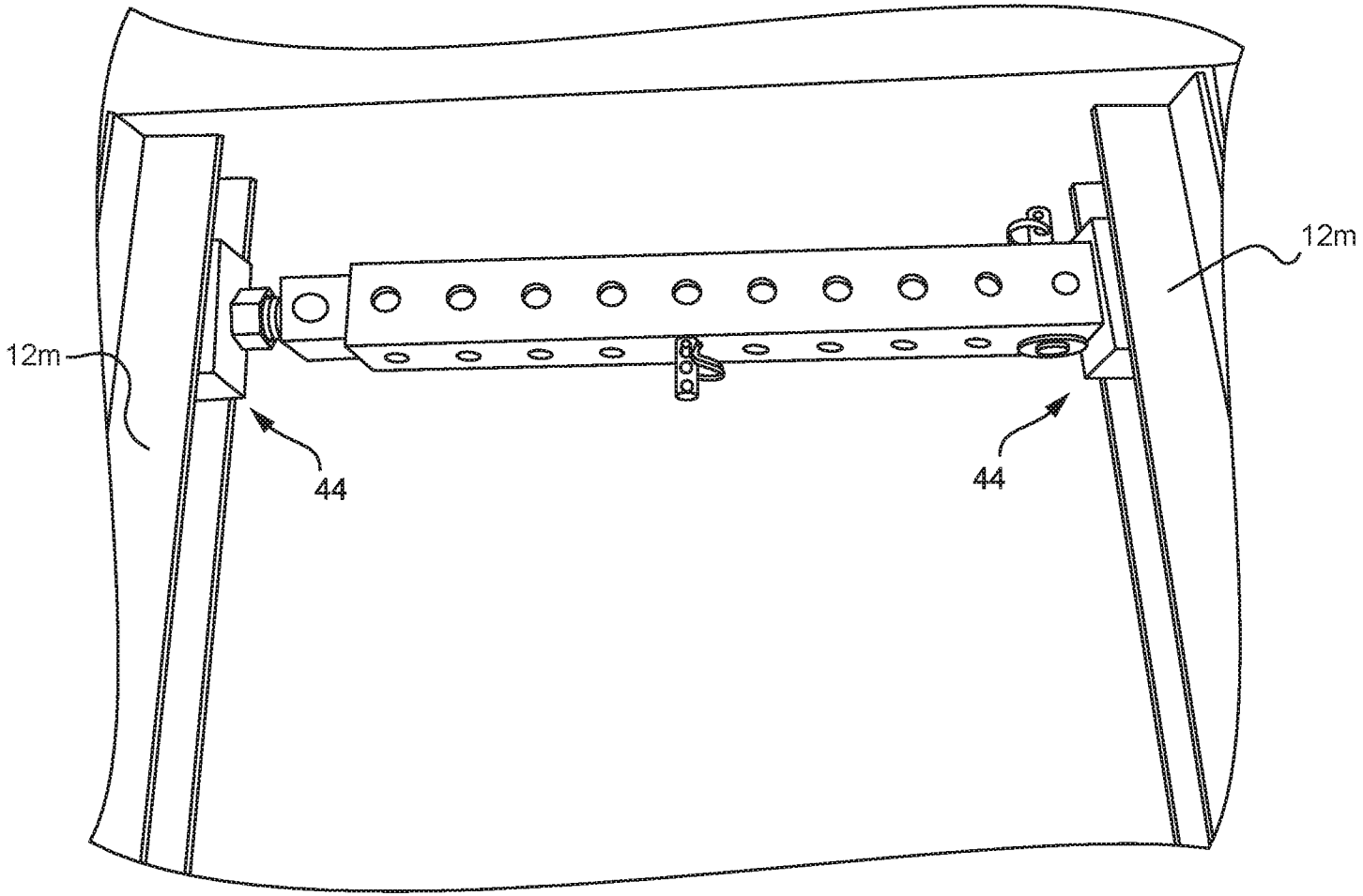
FIG. 20 is a top view of a section of a flooring assembly in accordance with an embodiment of the technology.
Figure 22:
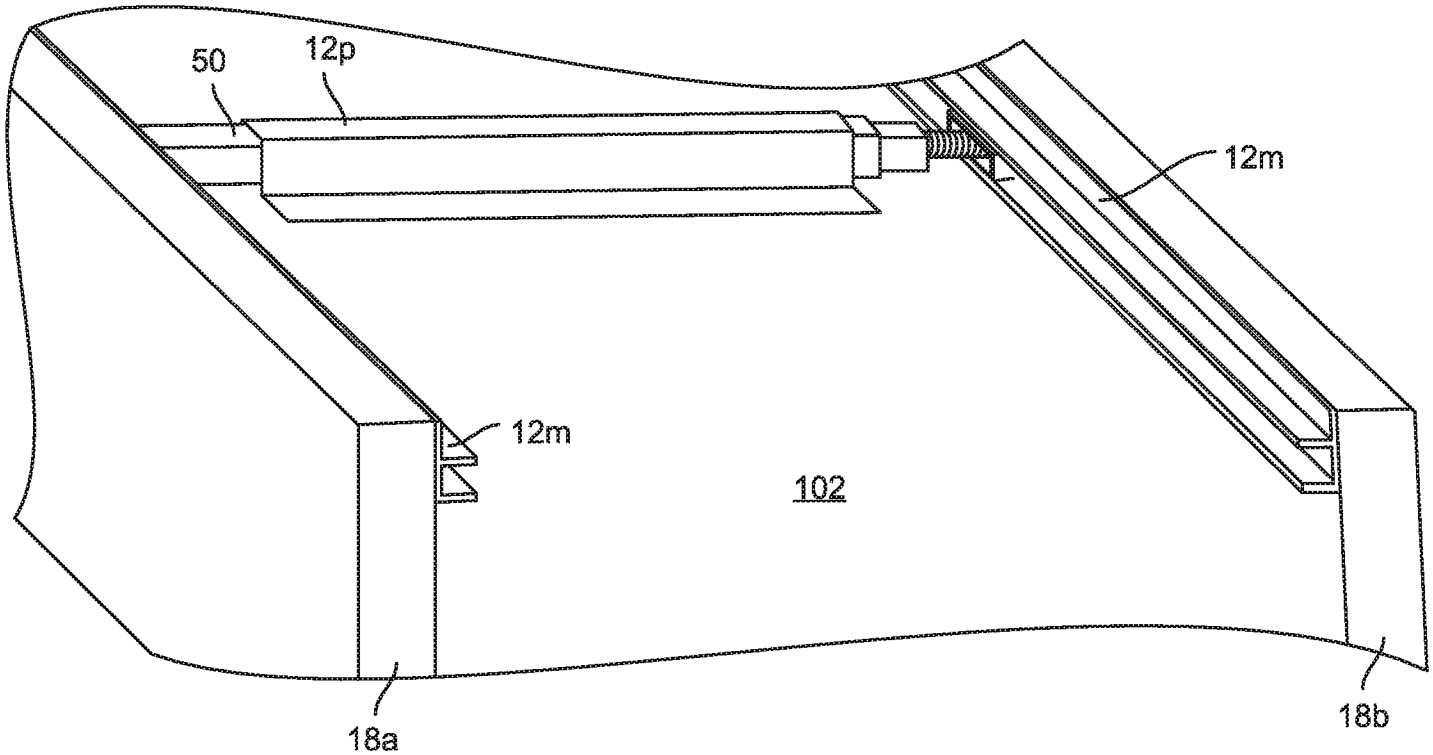
FIG. 22 is a perspective view of another flooring assembly in accordance with an aspect of the technology, showing an alternate embodiment of a lateral or end brace.

FIGS. 18A and 18B illustrate various endcap configurations that can be incorporated into the present technology. Generally, each different type of endcap can be interchangeably installed on either end of the spanning brace, to enable use of the spanning brace with a variety of configurations of shower spaces and floor support arrangements. For example, the configurations shown in FIGS. 20-22 illustrate use of the spanning brace 50 with two lateral braces 12*m*, utilizing end cap 44. In the configuration shown in FIGS. 14A and 19, one endcap 44 is coupled to the spanning brace for cooperating with a lateral brace while one endcap 42 is used that includes fasteners 64 that can be at least partially driven into lateral, side surfaces of the floor supports.

Figure 23:
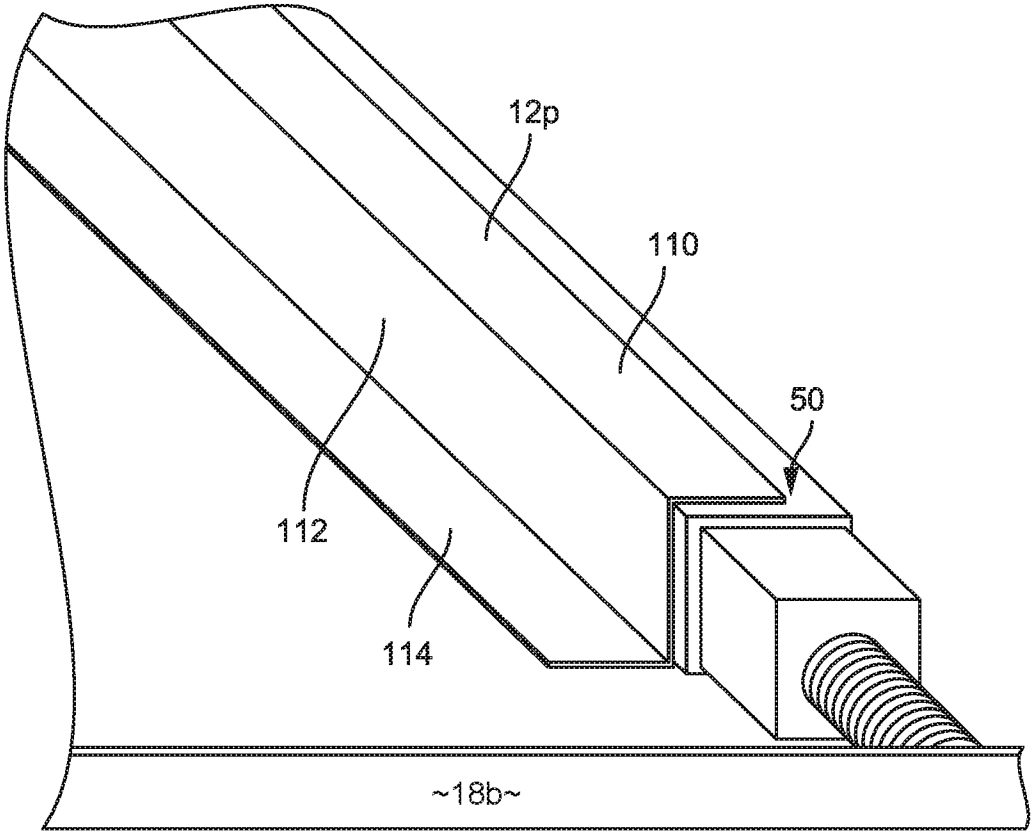
FIG. 23 is a more detailed view of the end brace of FIG. 22, shown installed atop a spanning brace.
Figure 24:
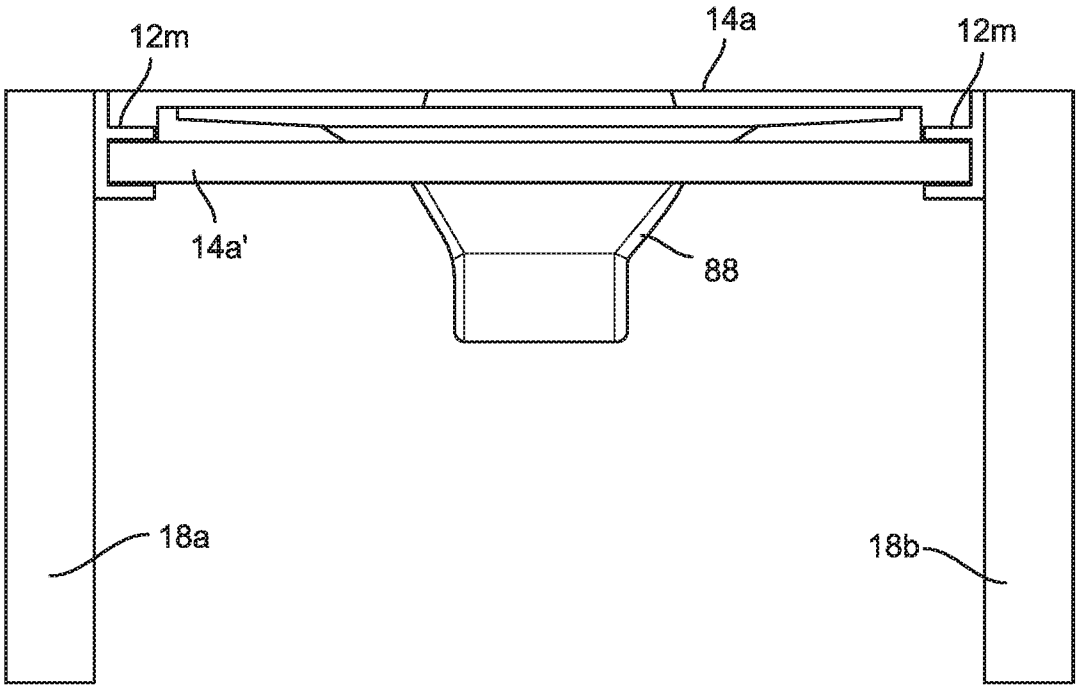
FIG. 24 is a side view of a subfloor installation including a drain component.

FIGS. 22-25 illustrate a further embodiment of the technology in which end bracket or brace 12*p* is used to support a further recessed subfloor panel 14*a*' (FIG. 24). As best shown in FIG. 23, end bracket or brace 12*p* generally includes a "Z" profile with an upper horizontal leg 110, a vertical connecting leg 112 and a lower horizontal leg 114. Horizontal leg 114 generally extends in an opposing direction from vertical leg 112 than does horizontal leg 110. Bracket 12*p* can be used to even further recess one or more components relative to recessed subfloor panel 14*a*. In the embodiment shown in FIG. 25, for example, a top surface of recessed panel 14*a*' is held substantially level with a top surface of spanning brace 50. In other words, lower horizontal leg 114 (see FIG. 23) is supporting the recessed subfloor panel 14*a*' while upper horizontal leg 110 (shown partially cutaway in this view) is being supported by the spanning brace 50 (see also FIG. 23, without the inclusion of any subfloor panels).

The end bracket or brace 12*p* can be coupled atop the spanning brace 50 (or any other brace or support structure) in a number of manners: it can be mechanically fastened atop the brace (e.g. using bolts, screws, adhesive, etc.), or it can be welded or otherwise formed integrally with the spanning brace during manufacture, etc.

Figure 25:
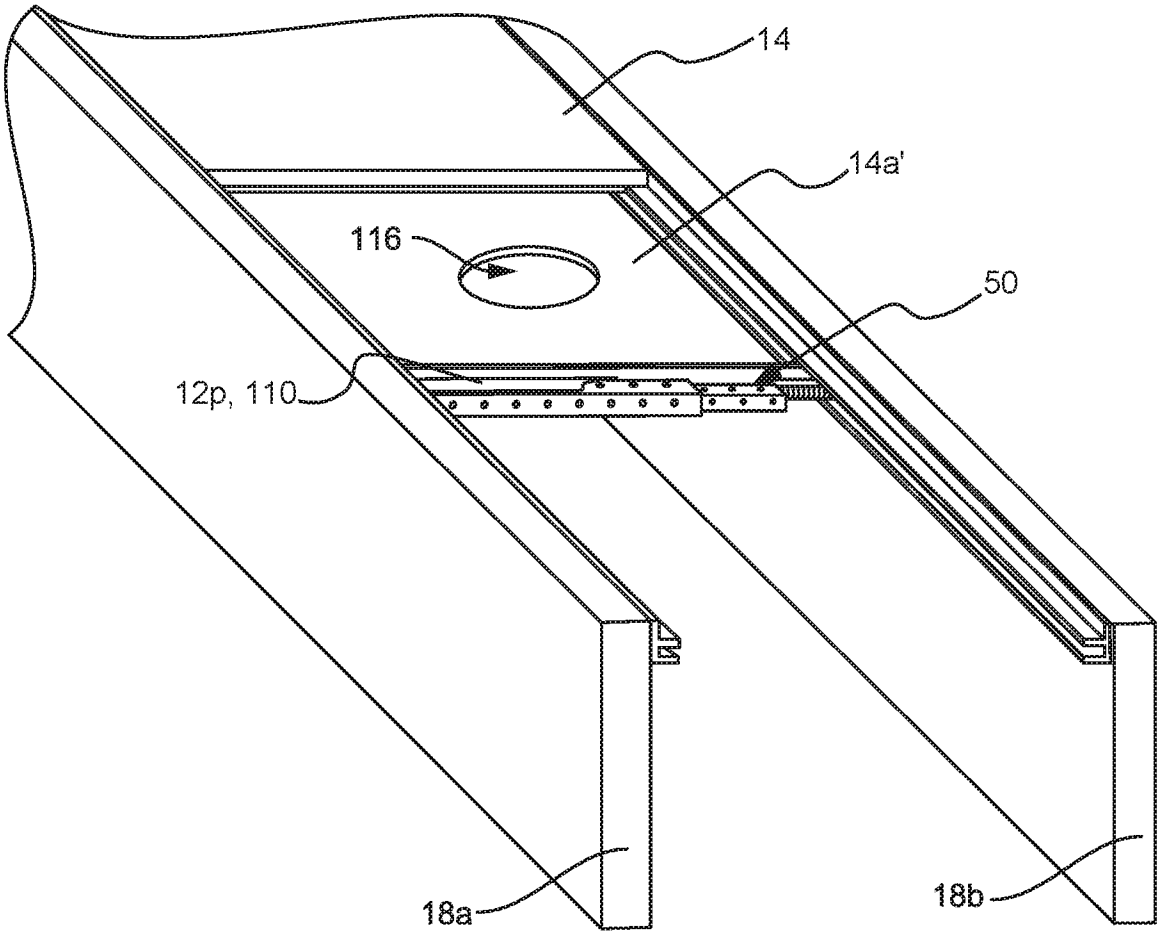
FIG. 25 is a perspective view of a flooring installation having recessed subfloor panels installed therein.

This aspect of the technology can be advantageous when it is desirable or necessary to lower a drain component even further than is possible by using recessed subfloor panel 14*a* as a support for the drain component. For example, as shown in FIG. 25, recessed subfloor panel 14*a*' can include an opening 116 formed therein into which the drain component (88 in FIG. 24) can be partially lowered and supported. By lowering the drain component in this manner, a necessary slope can be maintained in the shower tray or mortar bed extending away from the drain to the primary subfloor elevation. Thus, larger installations can be accommodated, even when the shower tray or mortar extends for some distance away from the drain structure.

In addition to the structural features discussed above, the present technology can also provide numerous methods of manufacturing, assembling, and using support brackets and braces; methods of installing floor installations; and methods of configuring floor installations.

The present support brackets can be formed from a variety of suitable materials, including, without limitation, extruded aluminum, steel, galvanized steel, etc. While not shown in detail in the figures, varying spacers or liners can be added between the subfloor panels and the support brackets (or between the subfloor panels and the shower tray panels) to adjust a height of the various panels.

The technology above is relatively easily installed in and around existing subfloors, even when access to the subfloors from below is not possible. Thus, portions of the subfloor panels can be removed from atop, the support bracketry can be installed from atop. After installation of these components, a shower tray panel or a mortar bed (neither shown) can be installed from atop, in the usual fashion. While not all of the support brackets shown may be necessary for any given installation, multiple support brackets can be provided in a kit to installers so that each bracket necessary for any particular installation is available to the installers. This can be particularly important in that the installer may not know which type of bracketry is necessary until he or she removes the subfloor panels.

It is to be understood that the above-referenced arrangements are illustrative of the application of the principles of the present technology. Numerous modifications and alternative arrangements can be devised without departing from the spirit and scope of the present technology as set forth in the examples.

We claim:

1. A method for supporting a recessed subfloor panel in a lowered position relative to an adjacent, primary subfloor, the primary subfloor including an overhanging portion extending over and being supported from beneath by one or more floor supports defining a bay therebetween, the method comprising:

positioning a spanning brace within a bay between a pair of floor supports with a first end of the spanning brace positioned beneath and at least partially overhung by an overhanging portion of the primary subfloor;

adjusting a length of the spanning brace at an opposing end of the spanning brace such that the spanning brace engages and is supported by lateral, vertical sides of the pair of floor supports; and supporting the overhanging portion of the primary subfloor atop and spaced at least a thickness of the recessed subfloor panel from the spanning brace;

supporting a recessed subfloor panel atop the spanning brace, the recessed subfloor panel being supported at a lower elevation than the adjacent, primary subfloor.

2. The method of claim 1, wherein the recessed subfloor panel includes a width equal to or less than a span distance between the lateral, vertical sides of the pair of floor supports.

3. The method of claim 1, further comprising at least one lateral brace carried by a side of at least one of the pair of floor supports, and wherein engaging the vertical sides of the floor supports includes engaging the lateral brace with an end of the spanning brace.

4. The method of claim 1, wherein engaging the vertical sides of the pair of floor supports includes engaging at least one floor support with cleats carried by an end of the spanning brace.

5. A flooring installation, comprising:

at least two floor supports separated from one another by a span distance, the at least two floor supports each having lateral, vertical side walls between which an opening is defined;

a bay, defined between the at least two floor supports;

a primary subfloor, supported atop and attached to one of the at least two floor supports, the primary subfloor including an overhanging portion overhanging a portion of the bay;

a lengthwise-adjustable spanning brace disposed between the at least two floor supports in the bay, the spanning brace engaging on opposing ends the lateral, vertical side walls of the floor supports, one end of the spanning brace extending beneath and spaced from the overhanging portion of the primary subfloor and an opposing end of the spanning brace being adjustable in length; and a recessed subfloor panel supported atop the spanning brace, the recessed subfloor panel being supported at a lower elevation than the overhanging portion of the adjacent, primary subfloor.

6. The installation of claim 5, further comprising one or more endcaps interchangeably coupleable to the ends of the spanning brace.

7. The installation of claim 6, further comprising one or more lateral braces coupleable to the lateral, vertical sides of the floor supports, the lateral braces cooperating with ends of the spanning brace to secure the spanning brace relative to the floor supports.

8. The installation of claim 7, wherein at least one of the endcaps includes a series of cleats operable to engage the sides of the floor supports.

9. The installation of claim 7, wherein at least one of the endcaps includes a support block operable to be received within a receiving opening formed in one of the lateral braces.

* * * * *